US006821230B2

(12) United States Patent
Dalebout et al.

(10) Patent No.: US 6,821,230 B2
(45) Date of Patent: Nov. 23, 2004

(54) TREADMILL WITH ADJUSTABLE CUSHIONING MEMBERS

(75) Inventors: William T. Dalebout, Logan, UT (US); Greg Law, Smithfield, UT (US)

(73) Assignee: Icon IP, Inc., Logan, UT (US)

( * ) Notice: Subject to any disclaimer, the term of this patent is extended or adjusted under 35 U.S.C. 154(b) by 265 days.

(21) Appl. No.: 09/953,589

(22) Filed: Sep. 12, 2001

(65) Prior Publication Data

US 2002/0045518 A1 Apr. 18, 2002

Related U.S. Application Data

(60) Continuation-in-part of application No. 09/777,141, filed on Feb. 5, 2001, which is a continuation of application No. 09/437,387, filed on Nov. 10, 1999, now Pat. No. 6,280,362, which is a division of application No. 09/160,947, filed on Sep. 25, 1998, now Pat. No. 6,174,267.

(51) Int. Cl.[7] ..... A63B 22/00
(52) U.S. Cl. ..... 482/51; 482/54
(58) Field of Search ..... 482/51, 54

(56) References Cited

U.S. PATENT DOCUMENTS

| | | | |
|---|---|---|---|
| 3,592,466 | A | 7/1971 | Parsons |
| 3,689,066 | A | 9/1972 | Hagen |
| 4,350,336 | A | 9/1982 | Hanford |
| 4,509,510 | A | 4/1985 | Hook |
| 4,548,405 | A | 10/1985 | Lee et al. |
| 4,576,376 | A | 3/1986 | Miller |
| 4,616,822 | A | 10/1986 | Trulaske et al. |
| 4,819,583 | A | 4/1989 | Guerra |
| 4,886,266 | A | 12/1989 | Trulaske |
| 4,938,473 | A | 7/1990 | Lee et al. |
| 4,984,810 | A | 1/1991 | Stearns et al. |
| 5,072,928 | A | 12/1991 | Stearns et al. |
| 5,088,729 | A | 2/1992 | Dalebout |

(List continued on next page.)

OTHER PUBLICATIONS

Kutz, M., ed., Mechanical Engineer's Handbook, 2nd ed., New York: John Wiley & Son Inc., 1998.
Hibbeler, R.C., Engineering Mechanics Statics, 4th ed., New York: Macmillan Publishing Company, 1986.
Precor USA M9.3 Low Impact Treadmill Brochure, Copyright 1990.
U.S. Patent Application Publication, Publication No. US 2002/0010055 A1, Publication Date: Jan. 24, 2002, Inventors: Dyer et al.

*Primary Examiner*—Glenn E. Richman
(74) *Attorney, Agent, or Firm*—Workman Nydegger; David B. Dellenbach

(57) ABSTRACT

A treadmill with an adjustable cushioning mechanism configured to adjustably cushion the impact of a user exercising on the treadmill. The adjustable cushioning members allow the user to select the amount of cushioning provided by adjusting the cushioning members to individualize the amount of cushioning for a specific user as well as for a particular type of exercise. The cushioning members are positioned on opposing sides of the treadmill frame and are interconnected such that movement of one of the cushioning members results in corresponding movement of the other of the cushioning members. The cushioning members are configured to be adjusted so as to selectively position a portion of the cushioning members between the frame and the deck of the treadmill. The cushioning members may optionally be adjusted manually or mechanically.

20 Claims, 15 Drawing Sheets

U.S. PATENT DOCUMENTS 5,184,988 A 2/1993 Dunham
5,250,012 A 10/1993 Meredith
5,279,528 A 1/1994 Dalebout et al.
5,330,401 A 7/1994 Walstead
5,336,144 A 8/1994 Rodden
5,344,372 A 9/1994 Hung
5,374,227 A 12/1994 Webb
5,382,207 A 1/1995 Skowronski et al.
5,441,468 A 8/1995 Deckers et al.
5,454,772 A 10/1995 Rodden
5,476,430 A 12/1995 Lee et al.
5,484,362 A 1/1996 Skowronski et al.
5,518,471 A 5/1996 Hettinger et al.
5,527,245 A 6/1996 Dalebout et al.
5,542,892 A 8/1996 Buhler
5,599,259 A 2/1997 Skowronski et al.
5,626,539 A 5/1997 Piaget et al.
5,634,870 A 6/1997 Wilkinson
5,649,882 A 7/1997 Parikh et al.
5,690,587 A 11/1997 Gruenangerl
5,749,807 A 5/1998 Webb
5,752,897 A 5/1998 Skowronski et al.
5,810,696 A 9/1998 Webb
5,827,155 A 10/1998 Jensen et al.
5,976,061 A 11/1999 Moon et al.
5,980,432 A 11/1999 Ahman
5,993,358 A 11/1999 Gureghian et al.
6,013,011 A 1/2000 Moore et al.
6,045,490 A 4/2000 Shafer et al.
6,050,921 A 4/2000 Wang
6,053,848 A 4/2000 Eschenbach
6,068,578 A 5/2000 Wang
6,095,951 A 8/2000 Skowronski et al.
6,132,340 A 10/2000 Wang et al.
6,174,267 B1 1/2001 Dalebout et al.
6,174,268 B1 1/2001 Novak
6,179,753 B1 1/2001 Barker et al.
6,234,936 B1 5/2001 Wang
6,280,362 B1 8/2001 Dalebout et al.
6,328,676 B1 12/2001 Alessandri
6,394,239 B1 5/2002 Carlson
6,436,008 B1 8/2002 Skowronski et al.

TREADMILL WITH ADJUSTABLE CUSHIONING MEMBERS

RELATED APPLICATIONS

This application is a continuation-in-part of U.S. patent application Ser. No. 09/777,141 entitled "Treadmill with Adjustable Cushioning Members," filed Feb. 5, 2001, which is incorporated by reference and which is a continuation of U.S. patent application Ser. No. 09/437,387, filed Nov. 10, 1999 U.S. Pat. No. 6,280,362, entitled "Treadmill with Adjustable Cushioning Members," which is incorporated by reference and which is a divisional of U.S. patent application Ser. No 09/160,947, filed Sep. 25, 1998 U.S. Pat. No. 6,174,267, entitled "Treadmill with Adjustable Cushioning Members," which is incorporated herein by reference.

BACKGROUND OF THE INVENTION

1. The Field of the Invention

The present invention relates to treadmills. More specifically, the present invention relates to treadmills with adjustable cushioning members that selectively cushion the impact caused by users when operating the treadmills.

2. Background and Related Art

Treadmills have become increasingly popular in recent years as exercise equipment that is used for either running or walking. Treadmills typically include an exercise platform having an elongate frame with a roller assembly mounted across opposite lateral ends of the frame. A belt is mounted for travel about the roller assembly and is controlled by a motor. The belt is flexible and unable to rigidly support the weight of the user. As such, a user is typically supported by a deck that is disposed between the upper portion of the belt and the frame and is made of a rigid material. As the user walks or runs on the belt, the belt is pressed against the underlying deck to provide mechanical support.

Some treadmills include decks that are directly affixed to the frame to provide a rigid support. As a result, the shock delivered to the deck from the user's step is reflected back to the foot, ankle and/or leg of the user in a similar manner as the reactive forces are imposed on a walker, a jogger or a runner exercising on a hard-paved surface or a sidewalk. Over long periods of time, the shock experienced by the user may provide detrimental effects to the joints of the user. Even in the short term, exercising on a rigid surface may prove to be tiring and jarring to a user. Attempts have been made to provide a way to cushion the impact reflected back to a user while still providing a rigid surface to support the belt and the user.

One method of attempting to cushion the impact reflected to a user is to provide an intricate shock absorbing system, which is attached to both the frame and the deck. However, the intricate shock absorbing system has proven to be difficult to manufacture and cost prohibitive. Another method includes attaching rubber blocks or cushioning strips along the length of the frame prior to mounting the deck to the frame. However, the rubber blocks or cushioning strips have proven to perform differently from one user to another due to the individual weight of the users. As a result, at times the cushioning has proven to be insufficient while at other times the cushioning has proven to be excessive, depending on the user. Another method includes the use of elastomeric springs that are positioned between the frame and the deck to provide an amount of resistance that is proportional to the extent that the deck deflected by a user while exercising.

Each user exercising on a treadmill does not cause the same amount of deflection. Furthermore, the amount of cushioning needed also depends upon the exercise that the user performs on the treadmill. For instance, running on the treadmill tends to require more cushioning than walking on the same treadmill. In addition, the amount of cushioning desired varies from user to user according to personal taste. As such, it would therefore be an advancement in the art to provide a treadmill that offers differing amounts of cushioning. A traditional attempt to provide individualized cushioning required physically removing strips of cushioning material and inserting other strips into the treadmill to selectively provide a desired amount of cushioning. This method proved to be time consuming and awkward.

As such, what is needed is a treadmill in which a user may selectively adjust the amount of cushioning provided without having to disassemble and remove pieces of the treadmill.

SUMMARY OF THE INVENTION

It is, therefore, an object of the present invention to provide a treadmill with a cushioning mechanism that can be selectively adjusted to provide differing amounts of cushioning to a user exercising on the treadmill.

It is another object of the present invention to provide a treadmill that can be conveniently adjusted to provide differing amounts of cushioning without disassembling the cushioning mechanism.

It is yet another object of the present invention to provide a treadmill with a cushioning mechanism that can be conveniently adjusted to provide differing amounts of cushioning depending on the different type of exercises to be performed on the treadmill.

A further object of the present invention is to provide a treadmill with a cushioning mechanism that can be selectively adjusted to provide differing amounts of cushioning based on individual preferences.

To achieve the foregoing objects, and in accordance with the invention as embodied and broadly described herein a treadmill with an adjustable impact absorbing mechanism is provided. The impact absorbing mechanism is configured to adjustably cushion the impact of a user exercising on the treadmill. The adjustable impact absorbing mechanism allows the user to select an amount of cushioning provided by selectively adjusting the impact absorbing mechanism.

The treadmill comprises a frame and an endless belt trained on the frame, wherein the belt has an upwardly exposed exercise section. A deck is disposed between the exercise section of the belt and the frame. A plurality of cushioning members are positioned on opposing sides of the frame such that each of the cushioning members includes a plurality of portions with different cushioning properties. The cushioning members are configured to be adjustable so as to selectively position a portion of the cushioning members between the frame and the deck and are mechanically interconnected such that movement of one of the cushioning members results in corresponding movement of the other cushioning members.

One embodiment includes an adjustable, flexible cantilever that comprises a flexible arm and a bumper. The arm includes one end that is mounted to the frame and the other end that is freely disposed from the frame. The bumper extends between the free end and the deck. The cantilever also includes a brace mounted to the frame adjacent to the cantilever, wherein the brace may be selectively moved along the length of the cantilever.

Another embodiment comprises an impact absorbing mechanism having a plurality of cushioning members that each rotate in a horizontal plane. Each cushioning member has a plurality of portions, each portion having different cushioning properties. Horizontal rotation of each cushioning member adjusts the amount of cushioning between the deck and frame. The cushioning members may have indicia thereon, e.g., numbers, that can be viewed by a user to determine the amount of cushioning selected.

In another embodiment, the impact absorbing mechanism comprises: (i) a spring; and (ii) a screw configured to extend therethrough. The screw is positioned in a hole that extends through the frame and/or treadmill deck. The pitch of the screw threads and the spring coil frequency correspond such that the screw threads within the inner diameter of the spring. As such, the rotation of the screw selectively extends or contracts the effective length of the spring, depending on the direction of rotation. Thus, adjustment of the screw correspondingly adjusts the degree of cushioning.

Additional objects, features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
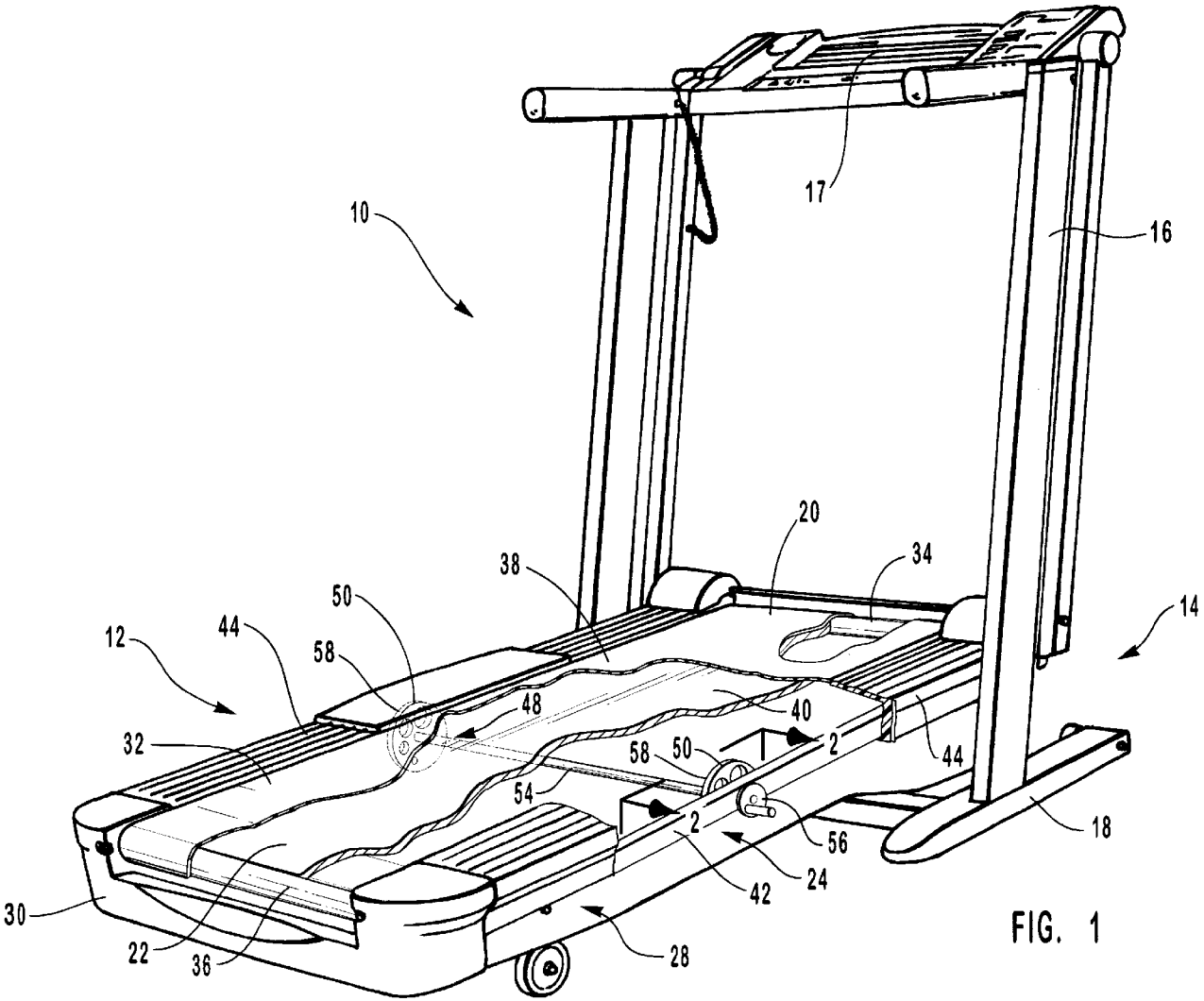
FIG. 1 is partial cutaway perspective view of a treadmill having an exemplary embodiment of a cushioning mechanism.

The present invention relates to treadmills with an impact absorbing mechanism that is configured to selectively adjust the cushioning of a user's impact. Depicted in FIG. 1 is one embodiment of a treadmill incorporating the features of the present invention. The adjustable impact absorbing mechanism in the present invention allows a user to select the amount of cushioning that will be provided by selectively adjusting the impact absorbing mechanism to individualize the amount of cushioning for a specific user as well as for a particular type of exercise. The adjustments made by a user to the impact absorbing mechanism are done without any disassembly of the treadmill.

As illustrated in FIG. 1, one embodiment of a treadmill 10 includes an exercise base and a support structure 14. Support structure 14 comprises a handrail 16 that extends upwardly from exercise base 12 and a feet means for supporting treadmill 10 upon a support surface such as a floor. One example of feet means is illustrated as feet 18, which are located on both the right side of handrail 16 and on the left side of handrail 16, wherein left and right are defined when a user is facing support structure 14 while standing on exercise base 12.

Handrail 16 may comprise an optional control console 17 that is attached to the upper end of handrail 16 and extends laterally over exercise base 12. Console 17 may have an operating control such as an actuator switch to operate treadmill 10 and an indicator means that may be operated by the user to determine various parameters associated with the exercise being performed. Console 17 may also include a cup or glass holder so that the user may position a liquid refreshment for use during the course of performing the exercise. Those skilled in the art will appreciate that various embodiments of consoles may be used. In fact, console 17 may only include on/off switch and therefore may be completely replaced by a lateral support member.

Exercise base 12 includes a front end 20 and a back end 22. As illustrated in FIG. 1, front end 20 of exercise base 12 is attached to support structure 14 and is rotatably attached to support structure 14 such that exercise base 12 may be rotated between an operational position, (illustrated in FIG. 1) and a storage position in which exercise base 12 is substantially vertical. Those skilled in the art will appreciate that various other methods of attaching exercise base 12 to support structure 14 are equally effective in carrying out the intended function thereof. In addition, there is no requirement that exercise base 12 be rotatable. It is contemplated that exercise base 12 can be fixedly attached to support structure 14.

Referring to FIG. 1, exercise base 12 comprises a frame 24 that includes a right frame member 28 and a left frame member (not shown). In FIG. 1, however, only the right side of treadmill 10 is visible. It is intended that the left side of frame 24 be a mirror image of the structure discussed relative to the right side. Right frame member 28 and left frame member (not shown) are in a spaced-apart, longitudinal relationship and are substantially parallel. Exercise base 12 also comprises a rear support member 30 that is attached to right frame member 28 and left frame member (not shown) at back end 22 of exercise base 12.

Exercise base 12 comprises a front roller 34 and a back roller 36 that are attached laterally near front end 20 and back end 22 of frame 24, respectively. An endless belt 32 is trained over front roller 34 and back roller 36 and is positioned between right frame member 28 and left frame member (not shown) so that belt 32 includes an upwardly exposed exercise section 38 upon which a user exercises.

Figure 2:
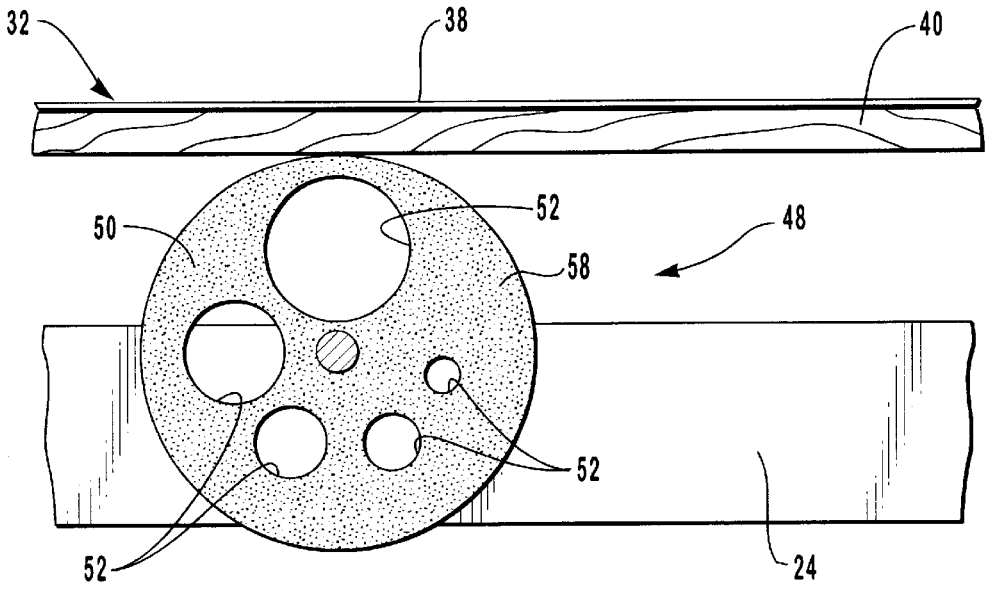
FIG. 2 is a partial cross-sectional elevation view of the cushioning mechanism shown in FIG. 1 taken along section line 2—2 therein.

As depicted in FIGS. 1 and 2, exercise base 12 includes a deck 40 that is disposed between exercise section 38 of belt 32 and frame 24. Deck 40 is substantially rigid and provides a rigid support to a user exercising on exercise section 38 of belt 32. Deck 40 and belt 32 are configured to receive a user thereon for the performance of exercise, including walking, running, jogging and other similar related activities. Treadmill 10 may also be used for stationary exercises such as stretching or bending while the user is standing on belt 32.

In one embodiment, the front end 20 and/or back end 22 of deck 40 are not secured to the frame. Instead, end 20 and/or 22 move freely from frame 24 to permit a greater adjustment of cushioning. For example, in one embodiment, the back end 22 of deck 40 is secured to frame 24 (through the use of screws, or similar connectors), but the front end 20 of deck 40 is not secured to frame 24. As such, the front end 20 deflects freely from frame 24 to permit a greater adjustment of cushioning applied to the front end 20 of deck 40.

However, in another embodiment, both front end 20 and back end 22 of deck 40 are secured to frame 24 and an adjustable cushioning is applied to the central portion of deck 40 between opposing ends 20 and 22. Optionally, the adjustable cushioning may be applied in front and/or in back of the points of securement of deck 40 to frame 24.

One embodiment of right frame member 28 and left frame member (not shown) comprises a side rail 42 and a side platform 44. As illustrated in FIG. 1, side platform 44 is positioned over the top of side rail 42 of both right frame member 28 and left frame member (not shown). Side platforms 44 are positioned on each side of belt 32 and are capable of supporting the weight of a user standing thereon.

The position of side platforms 44 are such that a user of treadmill 10 can comfortably and easily step off of belt 32 onto one or both of side platforms 44. A user can also stand on side platform 44 on either side of exercise base 12 until he or she is ready to step onto belt 32. It can be appreciated that other embodiments of frame 24 that include right frame member 28 and left frame member (not shown) or the components thereof are equally effective in carrying out the intended function thereof.

The present invention includes an impact absorbing mechanism 48 that is configured for manual adjustment to provide selectable amounts of impact cushioning when a user is operating on exercise section 38 of belt 32. Impact absorbing mechanism, which is an example of an impact absorbing means, allows the amount of cushioning provided by treadmill 10 to be manually adjusted to individualize treadmill 10 for different uses and/or users.

One embodiment of impact absorbing mechanism 48 is depicted in FIGS. 1 and 2. In FIG. 1, impact absorbing mechanism 48 comprises a plurality of cushioning members 50 that are positioned between deck 40 and frame 24. Although FIG. 1 illustrates two (2) cushioning members 50, it can be appreciated that various other numbers of cushioning members 50 may be used. Cushioning members 50 are attached to opposing sides of frame 24 and are at least partially disposed between frame 24 and deck 40. Cushioning members 50 are substantially opposite to each other on frame 24 and are substantially perpendicular to deck 40. Cushioning members 50 comprise a plurality of portions having different cushioning properties. In FIG. 1, cushioning members 50 are attached to the inside surface of frame 24. It is contemplated, however, that cushioning members 50 may be attached to the outside surface of frame 24 and perform the function thereof equally effectively.

Cushioning members 50 comprise flexible bases 58 that include apertures 52 of varying sizes. As the size of aperture 52 increases, the stiffness of that portion of base 58 cushioning members 50 decreases. As a result, the size of aperture 52 in base 58 of cushioning members 50 is related to the flexibility provided by that portion of cushioning members 50. The portions of cushioning member 50 include different cushioning properties due to the varying size of the apertures to allow a user of treadmill 10 who may desire less cushioning, for example, to manually adjustably position cushioning members 50 so that the portion of cushioning members 50 with the smallest aperture 52 and, therefore, the least flexibility is proximate to deck 40. In this position, cushioning members 50 have an increased stiffness that results in less cushioning. In contrast, when more cushioning is desired, cushioning members 50 are rotated to adjust cushioning members 50 so that a portion of bases 58 with progressively increasing sized apertures is against deck 40 to increase the flexibility and cushioning of cushioning members 50.

As shown in FIGS. 1 and 2, bases 48 of cushioning members 50 are configured in a disk-like shape. While bases 58, as shown, are substantially planar, it is not required that bases 58 be planar. Instead, bases 58 may have various other configurations such as elliptical, oval, or octagonal. The shape of bases 58 is not particularly important since various other configurations of bases 58 are equally effective in carrying out the intended function thereof. What is important is that bases 58 of cushioning members 50 have portions of differing amounts of stiffness to correspondingly provide different amounts of cushioning in absorbing the impact between deck 40 and frame 24 when a user is operating on exercise section 38 of belt 32. Cushioning members 50 provide selectable amounts of impact cushioning.

As illustrated in FIG. 1, impact absorbing mechanism 48 also comprises means for selectively adjusting cushioning members 50 so as to selectively position one of the plurality of portions of cushioning members 50 between frame 24 and deck 38. For example, manually a user may be able to physically move or rotate cushioning members 50 or press a button on console 17 to cause cushioning members 50 to be automatically and selectively adjusted to provide the desired amount of cushioning.

One example of a structure capable of performing the function of such a means for selectively adjusting cushioning members 50 comprises a handle 56. As depicted in FIG. 1, one embodiment of handle 56 is mounted outside frame 24 and is attached to one of cushioning members 50. Handle 56 is configured to cooperate with frame 24. Other embodiments of handle 56 perform the function thereof equally effectively. For example, handle 56 may be a knob attached to base 58 of one of cushioning members 50, particularly if cushioning members 50 are attached to the outside surface of frame 24. Handle 56 may be elongated, oval, round, square, or may include various other geometric shapes. Handle 56 must just be something that the user can easily grasp. Other embodiments of handle 56 may include some type of an elongated lever or rod. If means for selectively adjusting cushioning members 50 is mounted on console 17, it may comprise a button that is indexed to automatically and incrementally adjust cushioning members 50 to the specific amounts of cushioning. Other embodiments of means for selectively adjusting cushioning members 50 are some sort of a lever that is slidable on console 17 or a knob attached to console 17 that may be selectively rotated. Either the knob, the lever or some other embodiment may be moved on the console 17 by the user to position bases 58 of cushioning members 50 to corresponding positions to provide the selected amount of cushioning.

Impact absorbing mechanism 48 may optionally comprise means for mechanically interconnecting cushioning members 50 such that movement of one of cushioning members 50 results in corresponding movement of the other second cushioning members 50. One embodiment of structure capable of performing the function of such a means for mechanically interconnecting the plurality of cushioning members 50 comprises an elongated axle 54 that is depicted in FIG. 1. Axle 54 is attached to cushioning members 50 and extends laterally therebetween. As the user of treadmill 10 adjusts one of cushioning members 50 using handle 56 to select the desired amount of cushioning, axle 54 translates the movement to the remaining cushioning members 50. Consequently, all of cushioning members 50 move substantially simultaneously to the selected position to provide the desired amount of cushioning.

As illustrated, axle 54 is substantially round. Axle 54 could, however, have other embodiments such as a square, an oval, a rectangle, or another shape. Various other configurations of means for mechanically interconnecting first and second cushioning members 50 are capable of performing the function thereof equally effectively. Alternatively, means for mechanically interconnecting cushioning members 50 may comprise a linkage or a cable as will be discussed in further detail below.

In those embodiments of impact absorbing mechanism 48 that do not comprise a means for mechanically interconnecting cushioning members 50, all of cushioning members 50 have means of adjusting cushioning member 50 so as to selectively position or select one of the plurality of portions 58 of cushioning member 50 between frame 24 and deck 40. For example, as depicted in FIG. 1, first and second cushioning members 50 may each have a handle, such as handle 56, attached thereto. This embodiment would require a user to first make the adjustment to first cushioning member 50 located on one side of treadmill 10 and then move to the opposite side to manually adjust to second cushioning member 50 or vice versa. The drawback with this embodiment is in that a user might forget to adjust cushioning members 50 on the opposite side or may inadvertently adjust only cushioning members 50 on one side of treadmill 10 resulting in cushioning members 50 having different settings.

A variety of different adjustable cushioning members may be provided along the length of the base 12 in order to provide a substantially horizontal deck 40. It is also possible to employ both adjustable and non-adjustable cushioning members between frame 24 and deck 40 in order to provide a substantially horizontal deck 40.

The remaining figures illustrate other embodiments of impact absorbing mechanisms and cushioning members. The majority of features previously discussed relative to FIGS. 1 and 2 apply to the remainder of the figures.

Figure 3:
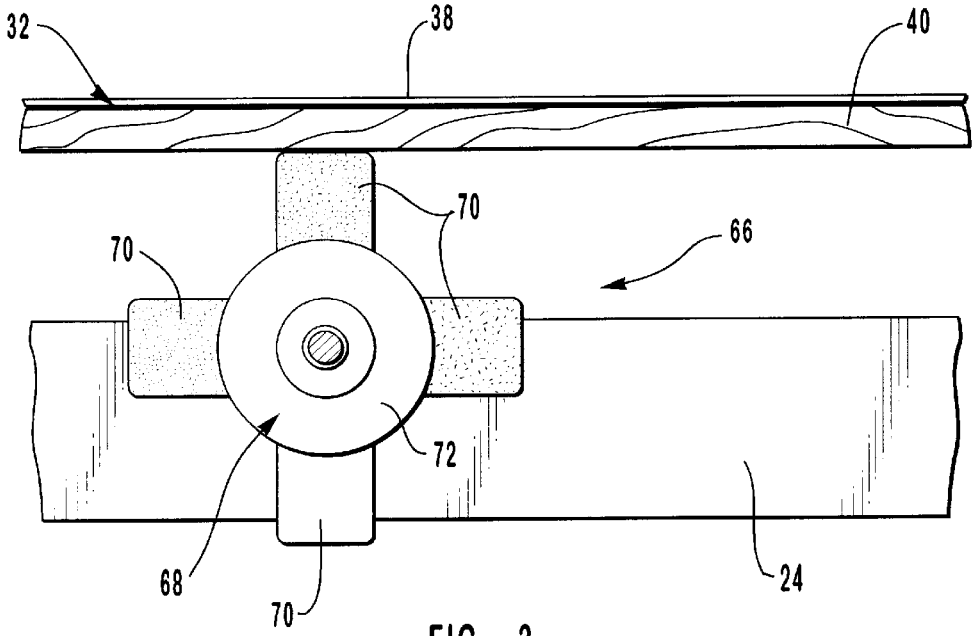
FIG. 3 is a partial cross-sectional elevation view of another exemplary embodiment of a cushioning mechanism.

FIG. 3 depicts another embodiment of impact absorbing mechanism 66. One of a plurality of cushioning members 68 is shown in FIG. 3. Impact absorbing mechanism 66 comprises a plurality of substantially identical cushioning members 68 that is movably attached to frame 24 and is substantially perpendicular to deck 40. As with cushioning members 50, cushioning members 68 each may be attached either inside or outside frame 24.

Cushioning members 68 comprise a plurality of portions having different cushioning properties. Cushioning members 68 each comprise a base 72 having a plurality of arms 70 projecting therefrom. In the embodiment depicted in FIG. 3, base 72 is substantially round. Various other configurations of base 72 are capable of performing the function thereof with equal effectiveness. Base 72 could, for example, alternatively be square, oval, elliptical, octagonal, triangular, or another shape. Arms 70 project radially from base 72. While FIG. 3 illustrates that cushioning members 68 have four (4) arms 70, it is contemplated that any number of arms 70 other than one (1) can be utilized. What is important is that the user can manually adjust cushioning members 68 to select between differing amounts of cushioning. Arms 70 and base 72 are substantially parallel.

Arms 70 of cushioning members 68 are made of various materials with each having a different stiffness characteristic such that each of arms 70 experiences a differing amount of deflection when contacting deck 40 in response to a force from the impact of a user on exercise section 38 of belt 32. In one embodiment of cushioning members 68, arms 70 are substantially comprised of materials selected from the group consisting of plastic, hard rubber, soft rubber, and cellular foam. Various other kinds of materials that have differing stiffness characteristics may alternatively be used. In addition, although depicted in FIG. 3 as being substantially rectangular, arms 70 may have other configurations such as being square, semispherical, half an ellipse, half an oval, or a truncated cone and perform the function thereof equally effectively.

Figure 4:
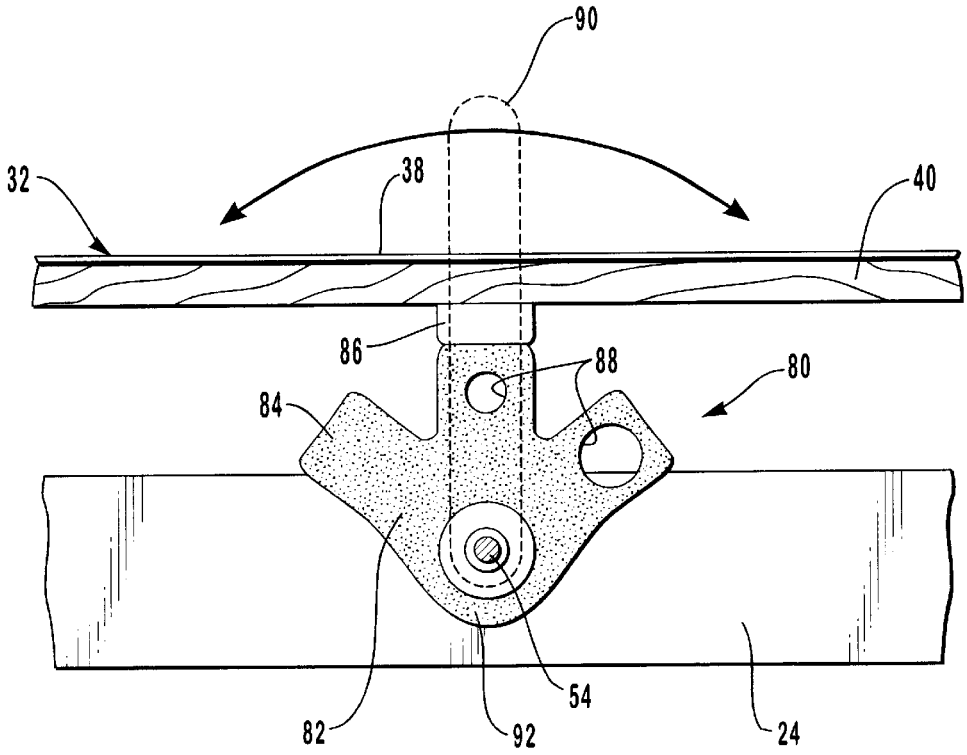
FIG. 4 is a partial cross-sectional elevation view of another exemplary embodiment of a cushioning mechanism.

FIG. 4 illustrates another embodiment of an impact absorbing mechanism 80 that comprises cushioning members 82. Like cushioning members 50 and 68 depicted in FIGS. 1–3, cushioning members 82 are movably attached to frame 24 and are disposed substantially perpendicular to deck 40. Cushioning members 82 comprise a plurality of portions having different cushioning properties. Cushioning members 82 comprise a base 92 with arms 84 extending therefrom. In this embodiment, cushioning members 82 are substantially fan-shaped. Like cushioning members 68 depicted in FIG. 3, cushioning members 82 have arms 84 extending outwardly from base 92. In this embodiment, as illustrated in FIG. 4, cushioning members 82 have three (3) arms 84. As previously mentioned, cushioning members 82 could, however, have various other numbers of arms 84.

Although cushioning members 68 and 92 illustrated in FIGS. 3 and 4 have arms 70 and 84, respectively, that are parallel to bases 72 and 92, respectively, arms 70 and 84 are not required to be parallel to bases 72 and 82. Instead, bases 72 or 92 could be mounted on frame 24 so as to be substantially parallel with deck 40. Arms 70 or 84 while extending outwardly from bases 72 or 92 now extend upward toward deck 40. For example, arms 70 and 84 could be "L-shaped." This embodiment of cushioning members performs the function thereof equally effectively.

Impact absorbing mechanism 80 includes an optional raised portion 86 on deck 40 that extends away from deck 40 toward frame 24. Raised portion 86 is configured to cooperate with arms 84 on cushioning members 82. Alternatively, raised portion 86 of deck 40 can be eliminated and arms 84 of cushioning members 82 extended to directly contact deck 40 as in the embodiment illustrated in FIG. 3.

Impact absorbing mechanism 80 with cushioning members 82, as depicted in FIG. 4, are somewhat similar to the embodiment of cushioning members 50 illustrated in FIG. 2. Like the embodiment depicted in FIG. 2, arms 84 or base 92 of cushioning members 82 have different sized openings 88 formed therein and form a plurality of portions in cushioning members 82 having differing cushioning properties. Openings 88 are differently sized and as a result arms 84 each have differing amounts of stiffness. As shown, one of arms 84 of cushioning members 82 does not have an opening 88 formed therein which further changes the stiffness of that arm 84. What is important is that each arm 84 have a discrete and differing amount of flexibility and deflection in response to a user exercising on belt 32 as a result of the differing stiffness. Cushioning members 82, consequently, will provide a differing amount of cushioning depending on which of arms 84 is in contact with deck 40.

Impact absorbing mechanism 80 also comprises an elongated lever 90, as shown in phantom in FIG. 4, configured to manually adjust cushion members 82. Lever 90 is one embodiment of structure capable of performing the function of selectively adjusting cushioning members 82 so as to selectively select one of the plurality of portions of cushioning members 82 between frame 24 and deck 40.

Figure 5:
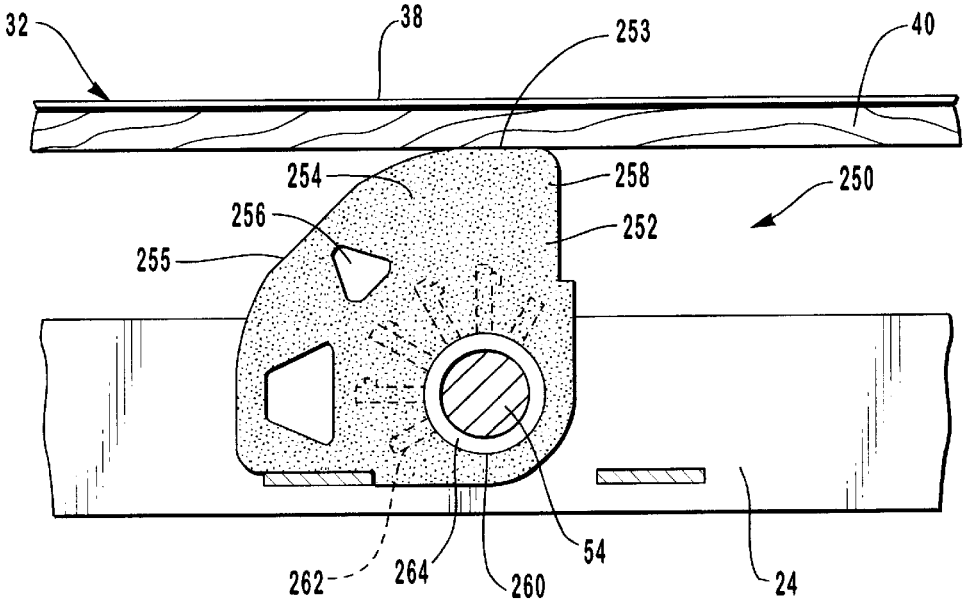
FIG. 5 is a partial cross-sectional elevation view of another exemplary embodiment of a cushioning mechanism.

FIG. 5 illustrates another embodiment of an impact absorbing mechanism 250 that comprises cushioning members 252. Like the cushioning members depicted in FIGS. 1–4, cushioning members 252 are movably attached to frame 24 and are disposed substantially perpendicular to deck 40. Cushioning members 252 comprise a plurality of portions having different cushioning properties. Cushioning members 252 comprise a substantially fan-shaped base 254 having different flattened surfaces 255 extending around the rim 253 of base 254.

Base 254 of cushioning members 252 has different sized openings 256 formed therein, forming a plurality of portions in cushioning members 252 having differing cushioning properties. Openings 256 are differently sized and as a result, different portions of base 254 have differing stiffness. As shown, one of the portions 258 of cushioning members 252 does not have an opening 256 formed therein. This further changes the stiffness of that portion 258. What is important is that each portion have a discrete and differing amount of flexibility and deflection in response to a user exercising on belt 32 as a result of the differing stiffness. Cushioning members 252, consequently, will provide a differing amount of cushioning depending on which portion contacts deck 40.

Impact absorbing mechanism 250 also comprises a hub 260 coupling base 254 to axle 54. Hub 260 includes fingers 262 (shown in phantom lines) extending radially from a hub sleeve 264 disposed about axle 54 and coupled to axle 54 through the use of a screw (not shown) disposed through sleeve 264 and axle 54. In one embodiment, base 254 comprises a flexible polyvinylchloride material which is molded onto a nylon or glass-filled nylon hub 260. By way of example, the polyvinylchloride material may have a durometer of about 65, shore A.

In one embodiment, impact absorbing mechanism 250 is positioned toward the front end 20 of base 12, e.g., within the front one-third of base 12. This positioning is particularly useful when the front end 20 of deck 40 is not secured to frame 24, e.g., when the back end 22 of deck is secured to frame 24 (through the use of screws, for example), while the front end 20 moves freely from frame 24. Allowing front end 20 to freely deflect from frame 24 enhances the ability to adjust the amount of cushioning applied to deck 40. In one such embodiment, front end 20 of deck 40 also rests on at least one additional cushioned member such as an isolator coupled to each side of frame 24, such as discussed below with reference to FIG. 11.

FIGS. **6*a*–6*c* illustrate another embodiment of an impact absorbing mechanism 270 that comprises cushioning members 272. Cushioning members 272 are movably attached to frame 24 and are disposed substantially perpendicular to deck 40. Cushioning members 272 comprise a plurality of portions having different cushioning properties. Each cushioning member 272 comprises a substantially fan-shaped base 274 having a plurality of recesses 275 extending around the rim 273 of base 274**.

Base 274 of cushioning member 272 comprises a flexible portion 277 attached through adhesion or molding to a substantially more rigid portion 276, forming a plurality of portions in cushioning members 272 having differing cushioning properties. As a result, different portions of base 274 have differing stiffness. Cushioning members 272, consequently, will provide a differing amount of cushioning depending on which portion contacts a wheel pivotally coupled to deck 40, as discussed below.

Impact absorbing mechanism 270 also comprises a hub 280 coupling base 274 to axle 54. Hub 280 comprises a hub sleeve 282 coupled to base 274. In one embodiment, hub sleeve 282 is integrally coupled to member 276 and to a plate 271, such that flexible portion 277 is cradled within plate 271, hub 280 and member 276.

Hub sleeve 282 is disposed about axle 54 and coupled to axle 54 through the use of a screw (not shown) disposed through sleeve 282 and axle 54, for example. In one embodiment, flexible portion 277 comprises a flexible polyvinylchloride material which is molded onto a significantly more rigid nylon or glass-filled nylon member 276 and plate 271. Hub 280 may also comprise nylon or glass-filled nylon.

By way of example, the polyvinylchloride material 277 may have a durometer of about 55, shore A.

Impact absorbing mechanism 270 further comprises a wheel 288 rotatably coupled to deck 40. In one embodiment, bracket 290 couples wheel 288 to deck 40. Wheel 288 is configured to mate with a selected recess 275 on cushioning member 272. Wheel 288 turns as cushioning member 272 turns. This assists in preserving the material of cushioning member 272 from damage as member 272 is turned. Stops 292 coupled to bracket 290 prevent the overrotation of cushioning member 272.

Figure 6A:
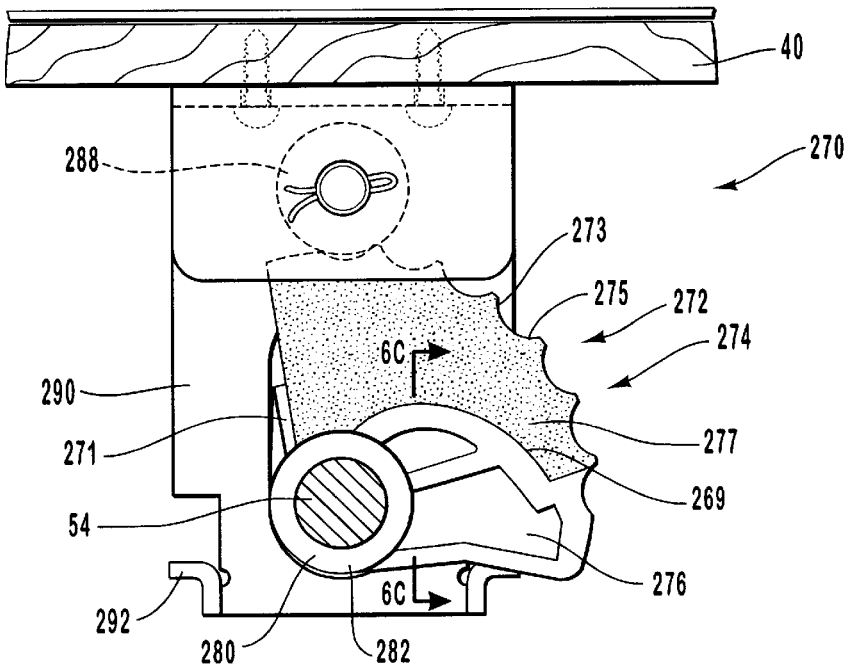
FIGS. 6A–6C feature partial cross-sectional elevation views of another exemplary embodiment of a cushioning mechanism.
Figure 6B:
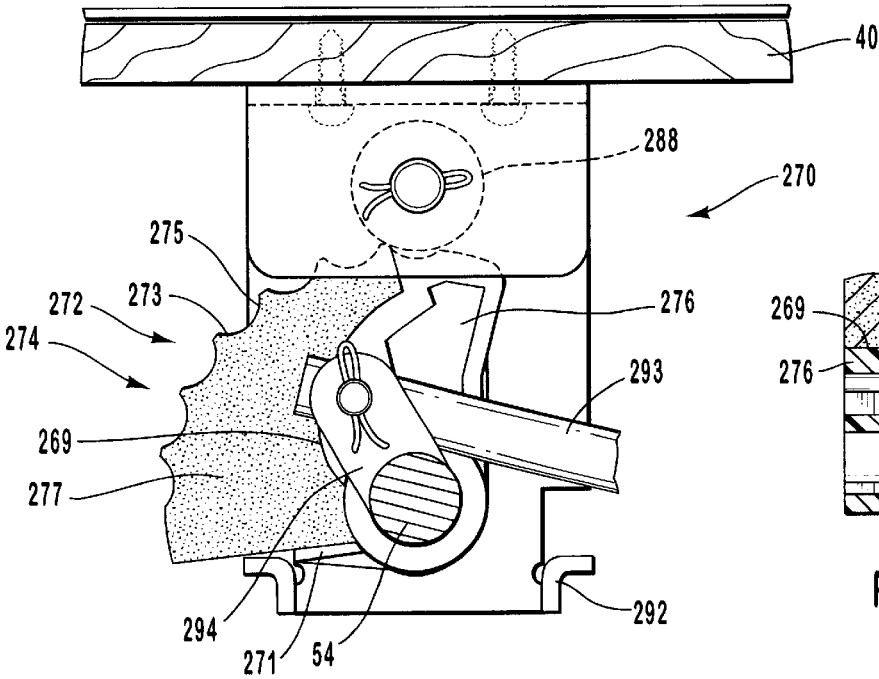

As yet another feature of impact absorbing mechanism 270, as shown in FIG. 6*b*, axle 54 includes a tab 294 coupled to axle 54. In a preferred embodiment, a motor, such as an extension motor, has an arm 293 thereof pivotally coupled to tab 294. Upon actuating the motor, such as by pressing a button coupled to the console of the treadmill, the motor rotates the axle 54. The button and motor pivotally coupled to axle 54 serve as another example of a structure capable of performing the function of selectively adjusting cushioning members 272 so as to select one of the plurality of portions of cushioning members 272 between frame 24 and deck 40.

In one embodiment, impact absorbing mechanism 250 is positioned toward the front end 20 of base 12, e.g., within the front one-third of base 12. One or both of front and back ends 20, 22 of deck 40 are secured to frame 24.

Figure 6C:
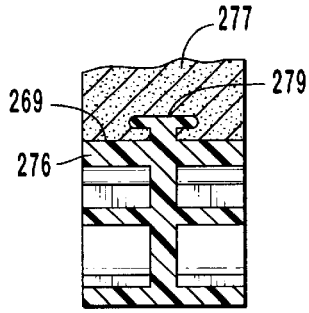

As shown in FIG. 6*c*, in one embodiment, rigid portion 276 comprises a rim 269 having a T-shaped member 279 extending therefrom. Member 279 is covered by flexible portion 277 and enhances the adhesion of flexible portion 277 to the more rigid portion 276.

Figure 7:
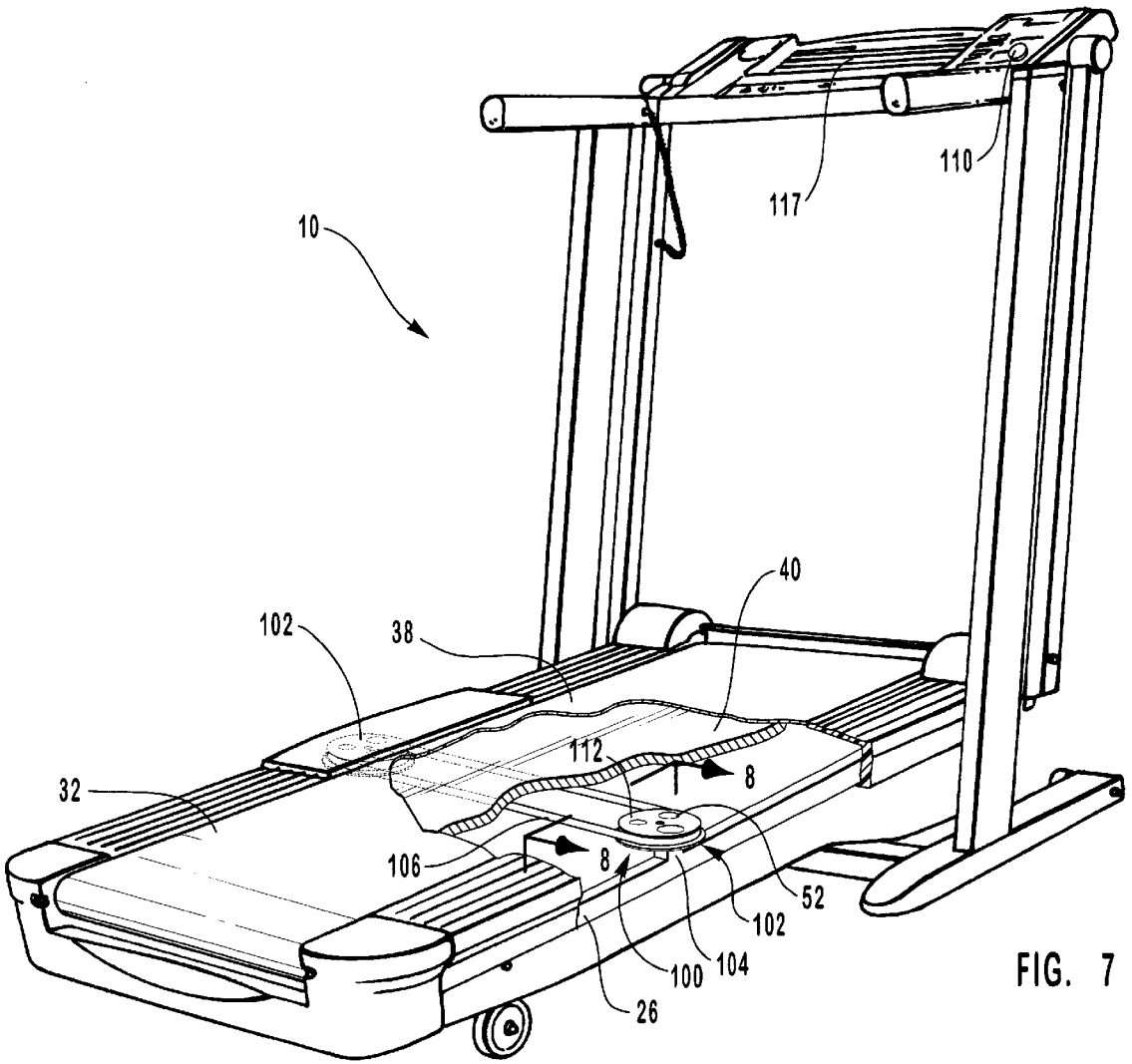
FIG. 7 is a partial cutaway perspective view of a treadmill having another exemplary embodiment of a cushioning mechanism.
Figure 8:
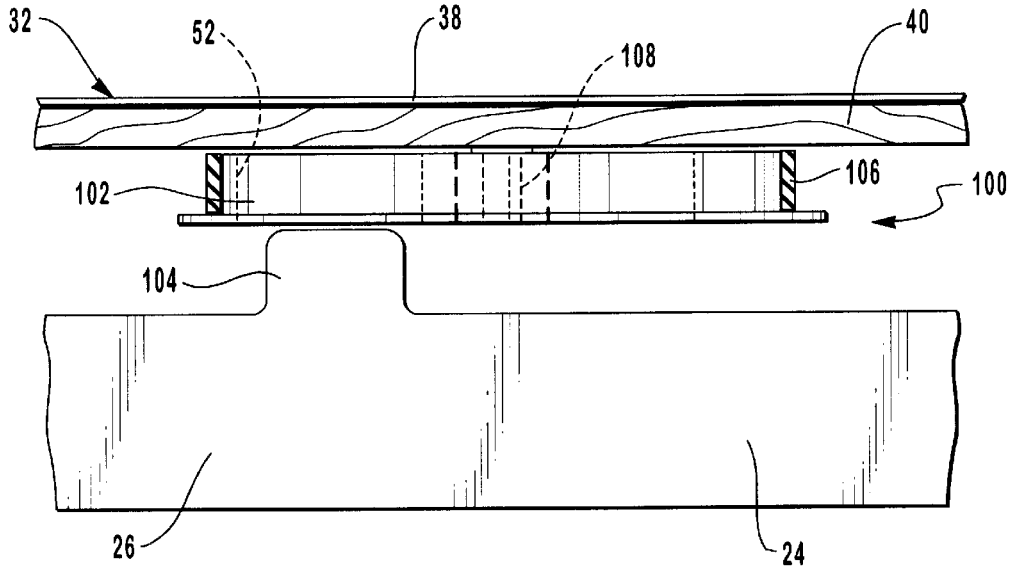
FIG. 8 is a partial cross-sectional elevation view of the cushioning mechanism of FIG. 7 taken along section line 8—8 therein.

FIGS. 7 and 8 depicts treadmill 10 with another embodiment of an impact absorbing mechanism 100 configured for manual adjustment to provide selectable amounts of impact cushioning when a user is operating on exercise section 38 of belt 32. Impact absorbing mechanism 100 comprises cushioning members 102. As shown in FIG. 8, cushioning members 102 are substantially parallel to deck 40 and are at least partially disposed between deck 40 and frame 24. Cushioning members 102 can be movably attached to either deck 40 or frame 24. As depicted in FIG. 8, cushioning members 102 are rotatably attached to deck 40 by a vertical axle 108.

Right frame member 26 and left frame member (not shown) of frame 24 have raised portion 104 formed thereon. Raised portions 104 extend upwardly towards deck 40 and contact cushioning members 102. Cushioning members 102 illustrated in FIGS. 7 and 8 have substantially the same configuration as cushioning members 50 depicted in FIGS. 1 and 2. Cushioning members 102 comprise a plurality of portions having different cushioning properties. Cushioning members 102 comprise a base 112 with a plurality of openings 52 formed therein. Bases 112 of cushioning members 102 are shown as round, but it is intended, particularly in this embodiment, that cushioning members 102 may have various other shapes without effecting the function thereof. Cushioning members 102 may be square, rectangular, oval, or various other configurations.

As depicted in FIG. 7, treadmill 10 has a knob 110 on console 117 that causes cushioning members 102 to be selectively adjusted according to the desired amount of cushioning. Knob 110 on console 117 is one embodiment of structure capable of performing the function of a means for selectively adjusting cushioning members 102 to provide differing amount of impact cushioning. Various other embodiments of structure capable of performing the function of such a means for selectively adjusting members 102 including those disclosed with other embodiments of cushioning members, are equally effective.

Impact absorbing mechanism 100 also comprises a linkage or a cable 106, shown in FIG. 7, configured to mechanically interconnect cushioning members 102 such that movement of one cushioning member 102 results in corresponding movement of other cushioning members 102. Various embodiments of structure capable of performing the function of such means for mechanically interconnecting cushioning members 102, including those disclosed with other embodiments of cushioning members, are equally effective. For example, horizontal axle 54 can be mechanically interconnected with vertical axles 108 of cushioning members 102 such that movement of one of cushioning members 102 results in corresponding movement of other cushioning members 102.

Although bases 112 of cushioning members 102 are depicted as having various sized openings 52 formed therein, other embodiments of cushioning members 102 perform the function thereof equally effectively. For example, instead of openings 52 formed in bases 112 of cushioning members 102, raised pads comprising materials with different cushioning properties can be mounted on cushioning members 102. Cushioning members 102 can be selectively adjusted such that the raised pads mounted on cushioning members 102 are selectively positioned on raised portion 104. In addition, instead of cushioning members 102 being pivotally mounted below deck 40, cushioning members 102 can be movably attached to frame 24 by vertical axles.

Figure 9:
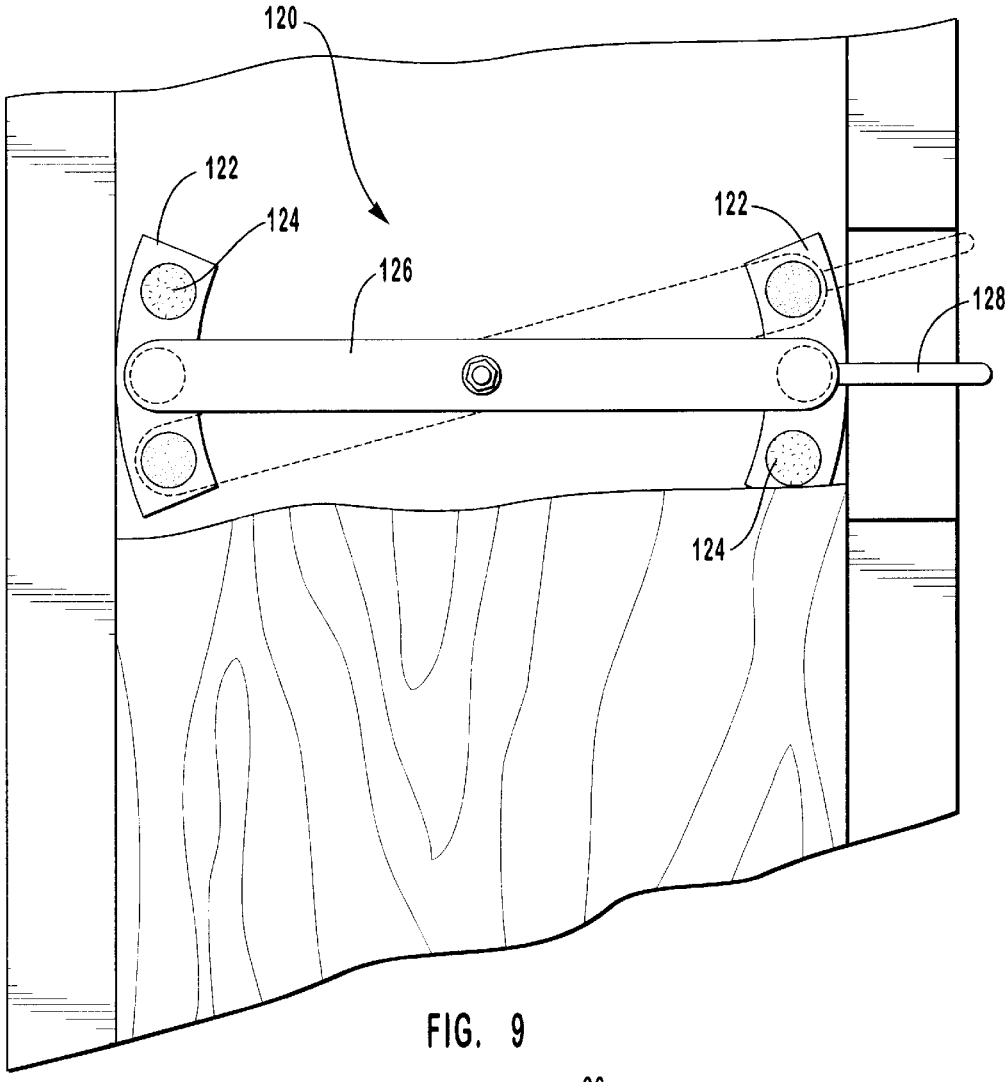
FIG. 9 is a partial cutaway top elevation view of another exemplary embodiment of a cushioning mechanism.

Another embodiment of an impact absorbing mechanism 120 is depicted in FIG. 9. Impact absorbing mechanism 120 comprises cushioning members 122 attached to opposite sides of frame 24. Cushioning members 122 are elongated and in the embodiment shown in FIG. 9 are substantially curved. Various other configurations, however, perform the function thereof equally effectively. For example, cushioning members 122 can be rectangular, square, semispherical, half an oval, half-an-ellipse, or semicircular. As illustrated, cushioning members 122 comprise bases 30 that have a plurality of raised pads 124 mounted thereon. Raised pads 124 each comprise a material with different cushioning properties. The arrangement of raised pads 124 on cushioning members 122 on side one is in an inverse mirror image cushioning members 122 on the opposite side of frame 24 as will be discussed in more detail below.

Impact absorbing mechanisms 120 also comprise an elongated beam 126 movably mounted below deck 40. Beam 126 extends across frame 24 and is substantially parallel to deck 40. A portion of beam 126 is disposed between deck 40 and cushioning members 122 to contact the various raised pads 124. Beam 126 is pivotally connected to deck 40. Raised pads 124 are arranged on cushioning members 122 so that beam 126 is pivoted to contact one type of raised pad 124 on cushioning members 122 and the opposite end of beam 126 contacts the same material on the opposite of cushioning members 122 as illustrated in FIG. 9.

Beam 126 is another embodiment of structure capable of performing the function of such means for mechanically interconnecting the plurality of cushioning members 122. Beam 126 has an elongated handle 128 attached to one end thereof for the user to grasp to selectively, manually adjust the amount of cushioning provided by cushioning members 122. A user of treadmill 10 can move beam 126 by moving handle 128 until beam 126 contacts the selected raised pads 124 to obtain differing amounts of cushioning of the impact. FIG. 9 illustrates in phantom an example of another position of beam 126 for a differing amount of cushioning. Handle 128 extends away from beam 126 above frame 24. Handle 128 is one example of structure capable of performing the function of means for selectively positioning one of the plurality of portions of cushioning members 122.

Cushioning members 50, 68, 82, 102 and 122 are one embodiment of structure capable of performing the function of impact absorbing means for selectively adjusting the cushioning impact between deck 40 and frame 24.

Figure 10:
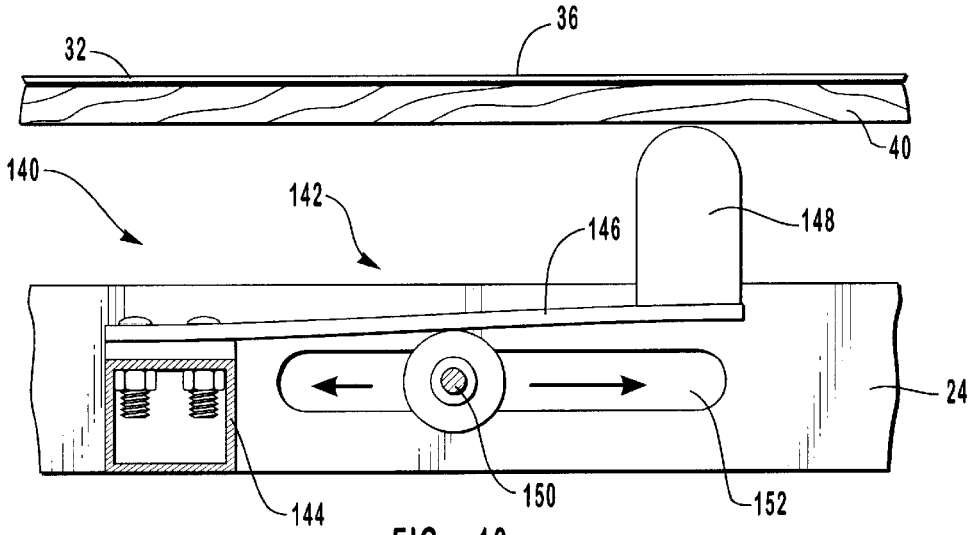
FIG. 10 is a partial cross-sectional elevation view of another exemplary embodiment of a cushioning mechanism.

FIG. 10 illustrates another embodiment of impact absorbing mechanism 140 that comprises a plurality of flexible cantilevers 142. Cantilevers 142 comprise a support 144 attached to the inside surface of frame 24 and extends in a direction away from frame 24. Cantilevers 142 comprise an elongated flexible arm 146 that is attached at one end to support 144. Arm 146 extends toward front end 20 of frame 24. Arm 146 has an opposite end that is freely disposed from support 144 and frame 24. Cantilevers 142 also comprise a bumper 148 mounted on the free end of arm 146. Bumper 148 extends away from free end of arm 146 toward deck 40 in a direction that is substantially perpendicular to deck 140.

Impact absorbing mechanism 140 includes an elongated brace 150 that is configured to manually adjust the flexibility of cantilevers 142. Brace 150 is mounted to frame 24 adjacent to cantilevers 142. Brace 150 extends substantially perpendicular to the longitudinal axis of frame 24 and is configured to cooperate with frame 24 and to move parallel to the longitudinal axis of frame 24. As depicted in FIG. 10, frame 24 has elongated slots 152 formed therein to accommodate movement of brace 150, which is selectively movable along the longitudinal axis of frame 24 and the length of cantilever 142 to change in the amount of cushioning provided by cantilevers 142 by increasing or decreasing the amount of deflection of arm 146 in response to a user operating on the exercise section 38 of belt 32. For example, if brace 150 is moved along the length of cantilevers 142 towards bumper 148 on arm 146, the amount of deflection or amount of cushioning is decreased. In contrast, if brace 150 is moved towards support 144, the amount of deflection will increase which consequently results in the amount of cushioning provided to the user increasing.

Various other configurations of brace 150 and slots 152 perform the function thereof equally effectively as long as brace 150 and slots 152 are configured to cooperate together. Brace 150 and slots 152 in frame 24 are one example of structure capable of performing the function of an adjustment means for selectively adjusting the flexibility of cantilever 142.

Figure 11:
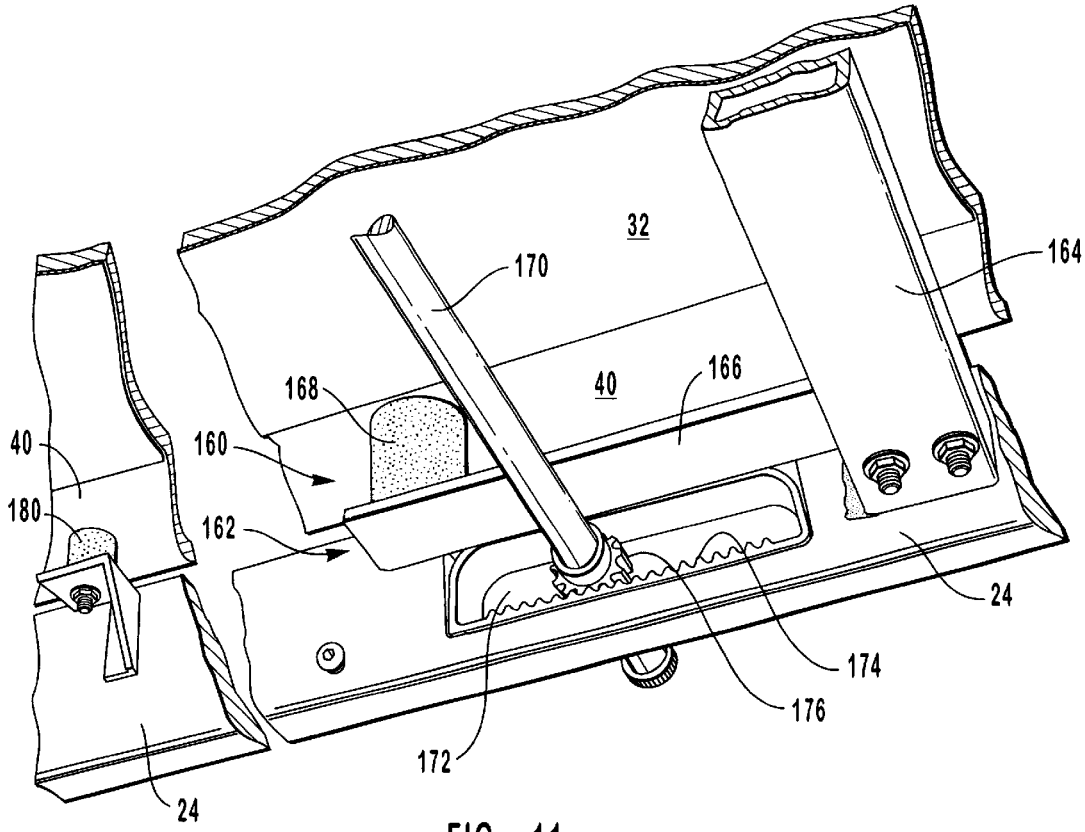
FIG. 11 is a partial cross-sectional perspective view of another exemplary embodiment of a cushioning mechanism.

FIG. 11 illustrates yet another embodiment of an impact absorbing mechanism 160 that comprises a plurality of flexible cantilevers 162, only one of which is shown in FIG. 11. Cantilever 162 comprises a support 164 attached to the inside surface of frame 24, such as a cross beam. Cantilever 162 further comprises an elongated arm 166, such as a steel or other metal arm that is attached at one end to support 164. Arm 166 extends toward front end 20 of frame 24. Arm 166 has an opposite end that is freely disposed from support 164 and frame 24.

Cantilever 162 also comprises a bumper 168 mounted on the free end of arm 166. Bumper 168 extends away from the free end of arm 166 toward deck 40 in a direction that is substantially perpendicular to deck 40. As another example of a cantilever, another elongated arm and a bumper attached thereto (not shown) extends from an opposing end of support 164 in parallel relationship to the cantilever 162 shown in FIG. 11. In one embodiment, bumper 168 is positioned toward the front end 20 of base 12, e.g., within the front one-third of base 12.

Impact absorbing mechanism 160 further includes an elongated brace 170 that is configured to manually adjust the flexibility of cantilevers 162. Brace 170 is mounted to frame 24 adjacent to cantilevers 162. Brace 170 extends substantially perpendicular to the longitudinal axis of frame 24 and is configured to cooperate with frame 24 and to move parallel to the longitudinal axis of frame 24.

As depicted in FIG. 11, frame 24 has elongated slots 172 formed therein to accommodate movement of brace 170. A second slot is not shown in FIG. 11, but is preferably on an opposing side of frame 24 from slot 172 for receiving an opposing end of brace 170 from that shown in FIG. 11. Brace 170 is selectively movable along the longitudinal axis of frame 24 within opposing slots 172 and along the length of opposing cantilevers 162 to change the amount of cushioning provided by cantilevers 162 by increasing or decreasing the amount of deflection of arms 166 in response to a user operating on the exercise section 38 of belt 32. For example, if brace 170 is moved along the length of cantilever 162 towards bumper 168 on arm 166, the amount of deflection or amount of cushioning is decreased. In contrast, if brace 170 is moved towards support 164, the amount of deflection will increase which consequently results in the amount of cushioning provided to the user increasing.

Also as shown in FIG. 11, in one embodiment, each of the opposing slots 172 have teeth 174 therein for selectively receiving gears 176 coupled to opposing ends of brace 170. Teeth 174 and gears 176 allow convenient adjustment of brace 170 within slots 172 and assist in maintaining brace 170 in a desired orientation within slots 172 during an exercise routine. By moving brace 170 forward and backward within opposing slots 172, each of the opposing cantilevers 162 is adjusted, preferably achieving an equal degree of deflection.

Various other configurations of brace 170 and slots 172 perform the function thereof equally effectively as long as brace 170 and slots 172 are configured to cooperate together. Brace 170 and slots 172 in frame 24 are one example of structure capable of performing the function of an adjustment means for selectively adjusting the flexibility of cantilever 162.

As mentioned above, in one embodiment, front end 20 of deck 40 is not secured to frame 24. Instead, back end 22 of deck 40 is secured to frame 24 (through the use of screws, for example), while front end 20 moves freely from frame 24, enhancing the ability to adjust the amount of cushioning applied to front end 20 of deck 40.

In one such embodiment, at least one and preferably both sides of front end 20 of deck 40 also rest on a cushioned isolator 180, shown in FIG. 11, without being coupled to the isolator 180. However, in another embodiment, front end 20 and back end 22 of deck 40 are both coupled to frame 24 through the use of screws, for example. The screws may be disposed through the deck, the frame, and an isolator, such as isolator 180 disposed between the frame and the deck, for example.

Figure 12:
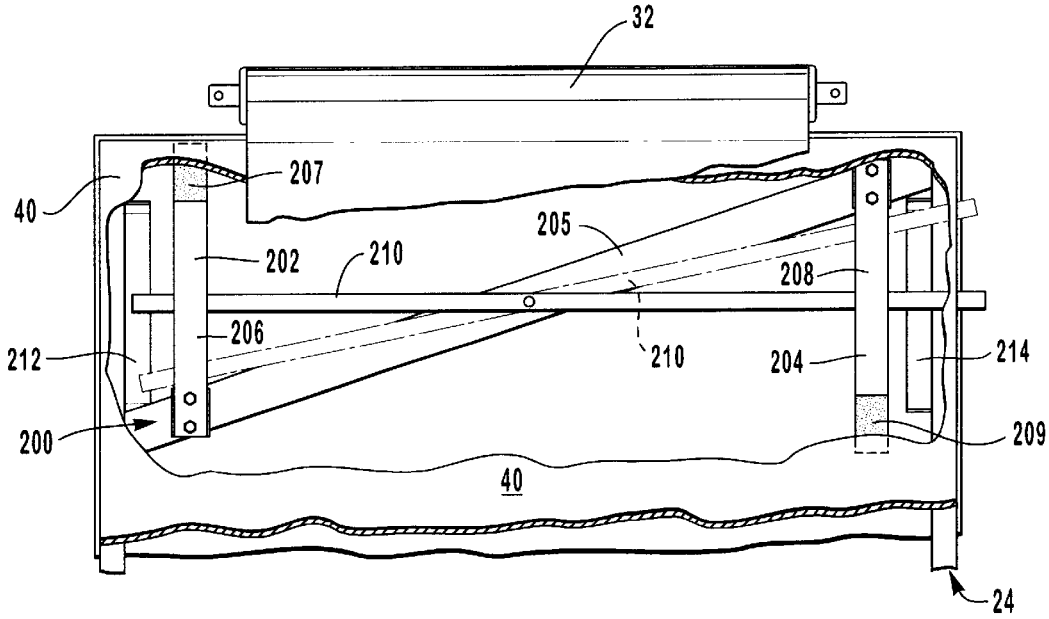
FIG. 12 is a partial cut-away top elevation view of another exemplary embodiment of a cushioning mechanism.

Another example of an impact absorbing mechanism 200 that comprises a plurality of flexible cantilevers 202, 204 is shown in FIG. 12. Cantilevers 202, 204 comprise a support 205 attached to frame 24 diagonally with respect to the longitudinal axis of frame 24. Cantilevers 202, 204 further comprise respective elongated arms 206, 208 attached to opposing ends of diagonal support 205. Bumpers 207, 209 are coupled to free ends of respective arms 206, 208 below deck 40. Bumpers 207, 209 extend upwardly with respect to respective arms 206, 208 and intersect deck 40. As shown, bumpers 207, 209 and arms 206, 208 of respective cantilevers 202, 204 are oriented in opposing directions.

Impact absorbing mechanism 200 further includes an elongated brace 210 that is configured to manually adjust the flexibility of cantilevers 202, 204. Brace 210 is mounted to frame 24 by being pivotally coupled to support 205. Brace 210 has opposing ends which are disposed beneath respective arms 206, 208. Frame 24 has elongated slots 212, 214 formed therein on opposing sides to accommodate pivotal movement of the ends of brace 210. Brace 210 moves along the length of opposing cantilevers 202, 204 to change in the amount of cushioning provided by cantilevers 202, 204 by increasing or decreasing the amount of deflection of arms 202, 204. One advantage of mechanism 200 is that the amount of cushioning provided is adjustable by pivoting brace 210 in a desired direction.

Brace 210 and slots 212, 214 in frame 24 are one example of structure capable of performing the function of an adjustment means for selectively adjusting the flexibility of cantilevers 202, 204.

It can be appreciated by those skilled in the art that although the various embodiments illustrated in the figures usually have two (2) cushioning members or two (2) cantilevers, any other number of a plurality of cushioning members or cantilevers can be used in treadmill 10.

Although not shown in the figures, it is contemplated that treadmill 10 (FIG. 1) includes structure such as a drive means for supplying power to exercise base 12 to drive continuous belt 32. The drive means for supplying power to base frame 12 is disposed in front end 20 of exercise base 12. One embodiment of structure capable of performing the function of such a drive means comprises a motor that rotates a first pulley and drives a belt. The belt drives a second pulley which is connected to front roller 34 about which belt 32 is disposed. As previously stated, the rear portion of belt 32 is also disposed around rear roller 36. Other embodiments capable of performing the function of such a drive means may include a flywheel. The flywheel is connected to belt 32 and receives energy from the user operating on belt 32 of exercise base 12. The flywheel also delivers energy to belt 32 as the user performs walking, running or jogging exercises when a user is suspended and not in contact with belt 32.

FIGS. 13–16*b* depict an alternate treadmill 310 with another embodiment of an impact absorbing mechanism 300 configured for selective adjustment to provide selectable amounts of impact cushioning when a user is operating on exercise section 338 of belt 332.

Figure 13:
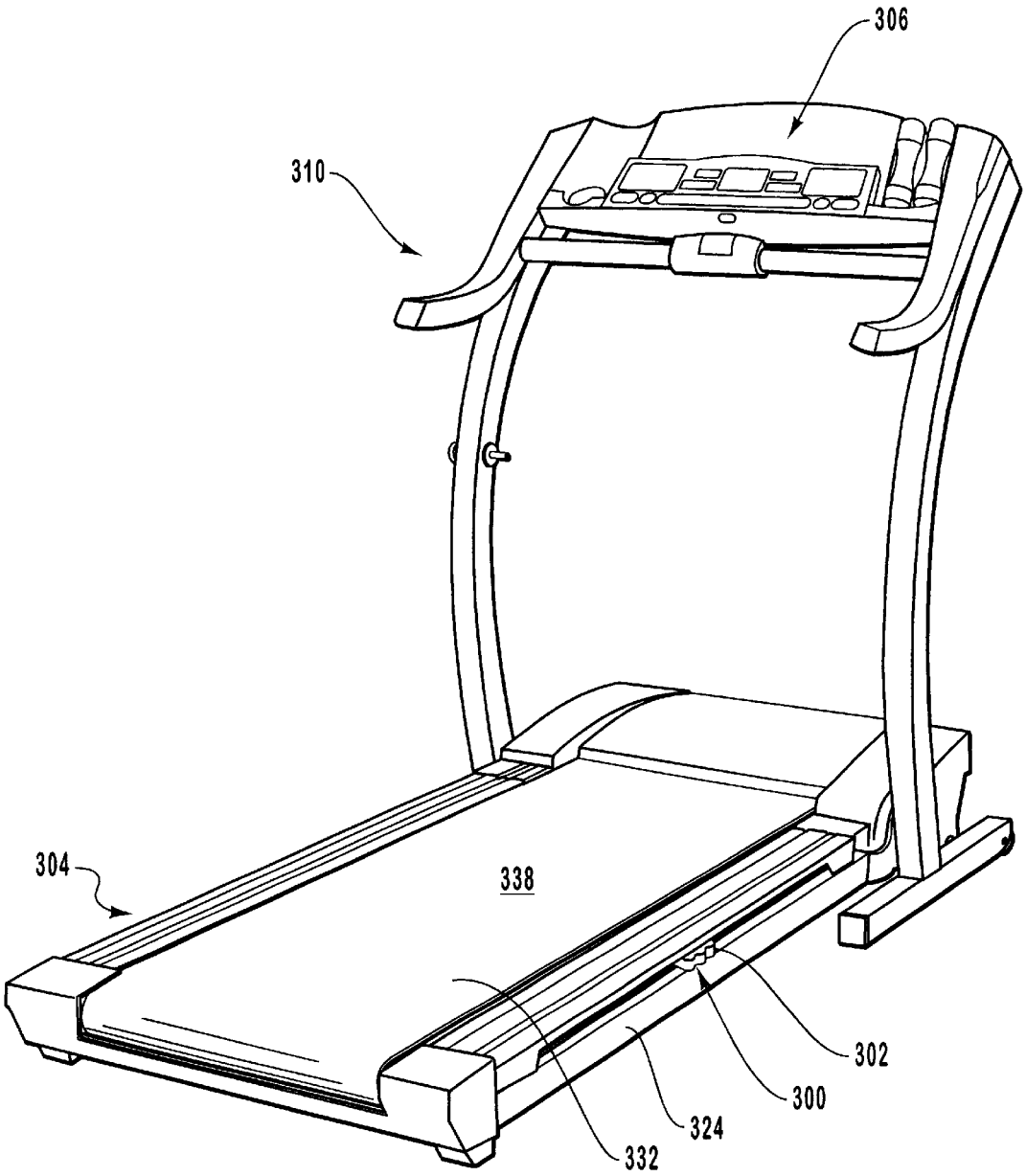
FIG. 13 is a perspective view of a treadmill having another exemplary embodiment of a cushioning mechanism.

Treadmill 310 comprises an exercise base 304 comprising: (i) frame 324, which can be the same or similar to the frame 24 of FIGS. 1 and 7; (ii) endless belt 332 trained about front and rear rollers coupled between opposing ends of right and left frame members 325, 326 (FIG. 15), such as discussed regarding belt 38 of FIGS. 1 and 7; (iii) a deck 340 (FIGS. 14–15) coupled to frame 324, such as discussed regarding deck 40 of FIGS. 1 and 7; and (iv) impact absorbing mechanism 300 at least partially disposed between deck 340 and frame 324. A support structure 306 is coupled to base 304 (e.g., rotatably coupled to the base 304 such that the base 304 can be selectively oriented in an operational position, as shown in FIG. 13, or an upright storage position).

Impact absorbing mechanism 300, which is another example of an impact absorbing means, comprises first and second cushioning members 302 (FIGS. 14–15) on opposing sides of treadmill 310. Cushioning members 302 are substantially parallel to deck 340 and are at least partially disposed between deck 340 and frame 324. While cushioning members 302 can be movably attached to either deck 340 or frame 324, in the embodiment of FIG. 14 cushioning members 302 are rotatably attached to deck 340 by a vertical axle 308, such that frame 324 of treadmill is contacted by downwardly extending cushioning members 302.

Member 302 has a plurality of portions, each of which have different cushioning properties, as will be discussed in detail below. To adjust the degree of cushioning, the user causes at least one and preferably both cushioning members 302 to rotate horizontally such that the desired cushioning portion is positioned between the treadmill deck 340 and frame 324.

As shown in FIGS. 14–16*b*, cushioning members 302 each comprise a base 312 with a plurality of arms 302*a*–*c* projecting therefrom. Arms 302*a*–*c*, each have different cushioning properties. Thus, cushioning members 302 each have a plurality of cushioning portions, namely arms 302*a*–*c*, each having different cushioning properties. Members 302 each have a generally triangular shape. However, it is intended that the cushioning members that rotate horizontally to adjust the degree of cushioning may have various other shapes without effecting the function thereof, such as square, rectangular, oval, propeller shaped, or various other configurations.

In order to selectively lock a desired arm 302*a*–*c* into a desired position, a spring loaded ball detent 318 (FIG. 14) engages one of three recessed areas 320*a*–*c* (FIG. 15) on the top surface of cushioning member 302, depending upon the degree of cushioning selected by the user. The recessed areas 320*a*–*c* are positioned so as to selectively engage the detent 318 and thereby hold the desired respective arm 302*a*–*c* in place between deck 340 and frame 324. The same result may be achieved by placing a detent in cushioning member 302 which could engage one of a number of different recessed areas in deck 340 or frame 324. Alternatively, the detent can be molded as part of cushioning member 302.

Differing degrees of cushioning can be achieved in cushioning members 302 by (i) providing cushioning portions comprising differing materials; (ii) providing cushioning portions having differing levels of flexibility; (iii) providing cushioning portions having different sizes and/or (iv) providing cushioning portions that are more hollow than others, for example. Thus, a variety of different methods of manufacture may be employed to form each member 302.

In the embodiment of FIGS. 14–16*b*, each member 302 is formed by forming a frame 314 configured to hold a plurality of cushioning pads 316*a*–*c* therein. Each arm portion 302*a*–*c* comprises (i) a respective frame portion 317*a*–*c*; and (ii) a respective pad 316*a*–*c* coupled to a respective frame portion 317*a*–*c*.

In the embodiment of FIGS. 13–16*b*, frame 314 comprises a rigid or semi-rigid material, while cushioning pads 316*a*–*c* each comprise a more flexible material that is coupled onto frame 314, e.g., through molding. Thus, frame 314 may comprise a material that is more rigid than pads 316*a*–*c* for example. In one embodiment, frame 314 is molded, after which pads 316*a*–*c* are molded thereon. By way of example, the frame and/or pad portions of cushioning members 302 can be formed from SANTOPRENE, PVC, thermoplastic elastomer, foam and/or other suitable material. For example, in one embodiment the frame 314 and pads 316*a–c* each comprise a SANTOPRENE material, but have different degrees of flexibility.

Figure 14:
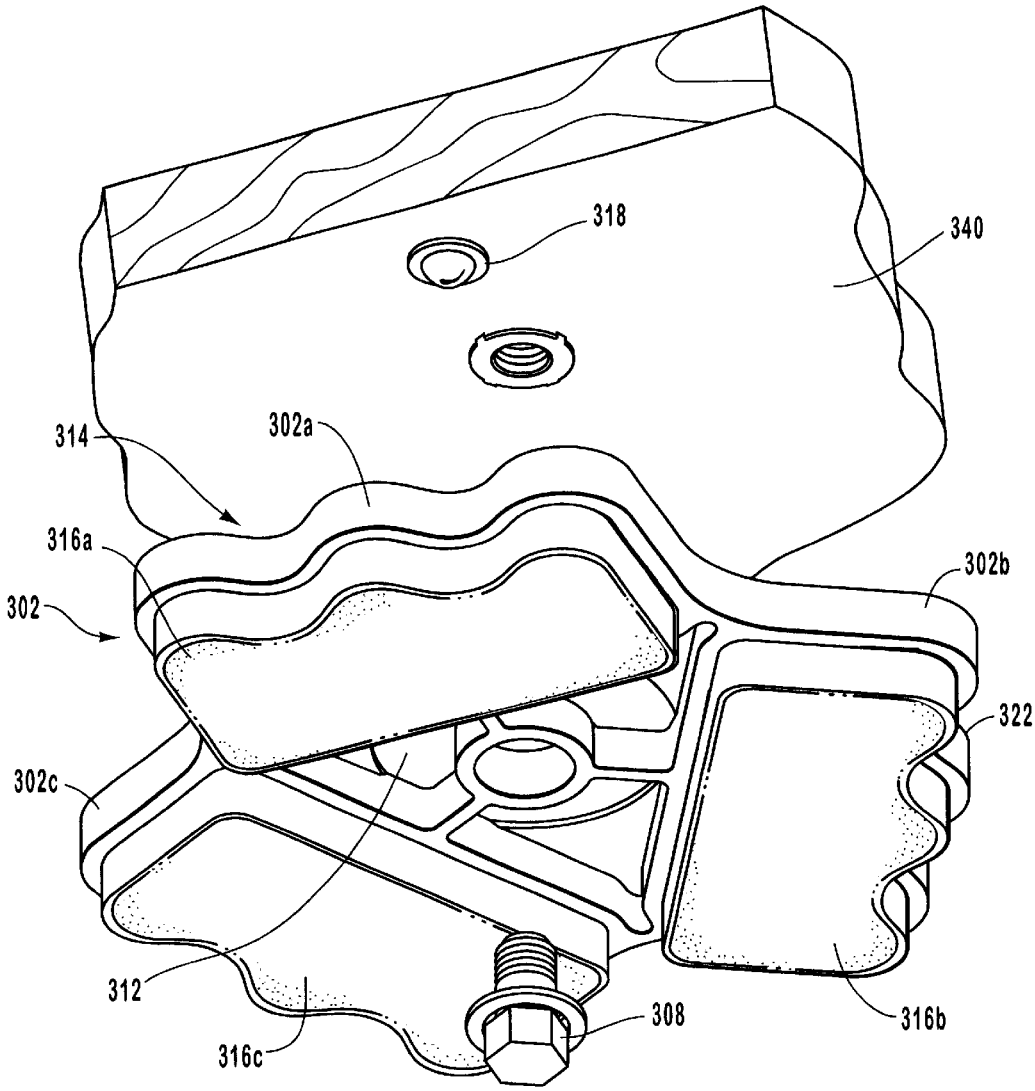
FIG. 14 is a bottom view of a cushioning member of the treadmill featured in FIG. 13 shown adjacent a deck illustrated in a cutaway, exploded view.
Figure 16A:
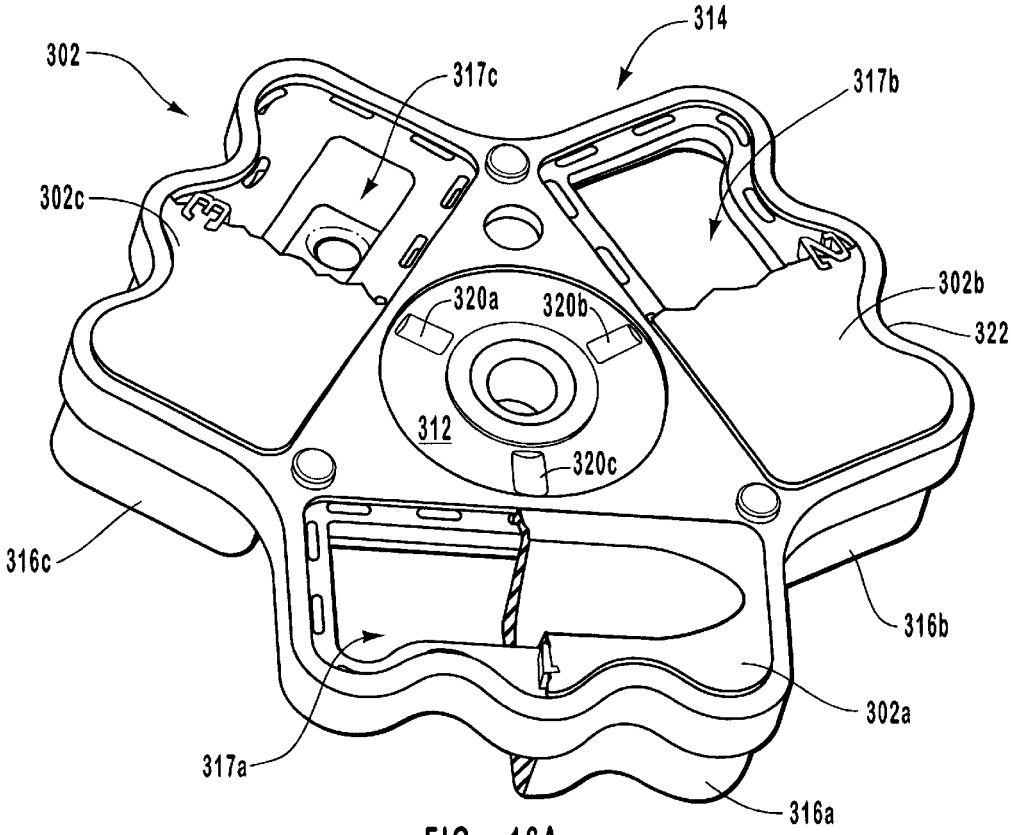
FIG. 16*a* is a top view of a cushioning member frame with cushioning pads shown in a cutaway view mounted therein.

Frame 314 is configured to receive different pads therein, the pads being shown in a bottom view in FIG. 14, and in a cutaway top view in FIG. 16*a*. A bottom view of the frame is shown without the pads in FIG. 16*b*.

Figure 16B:
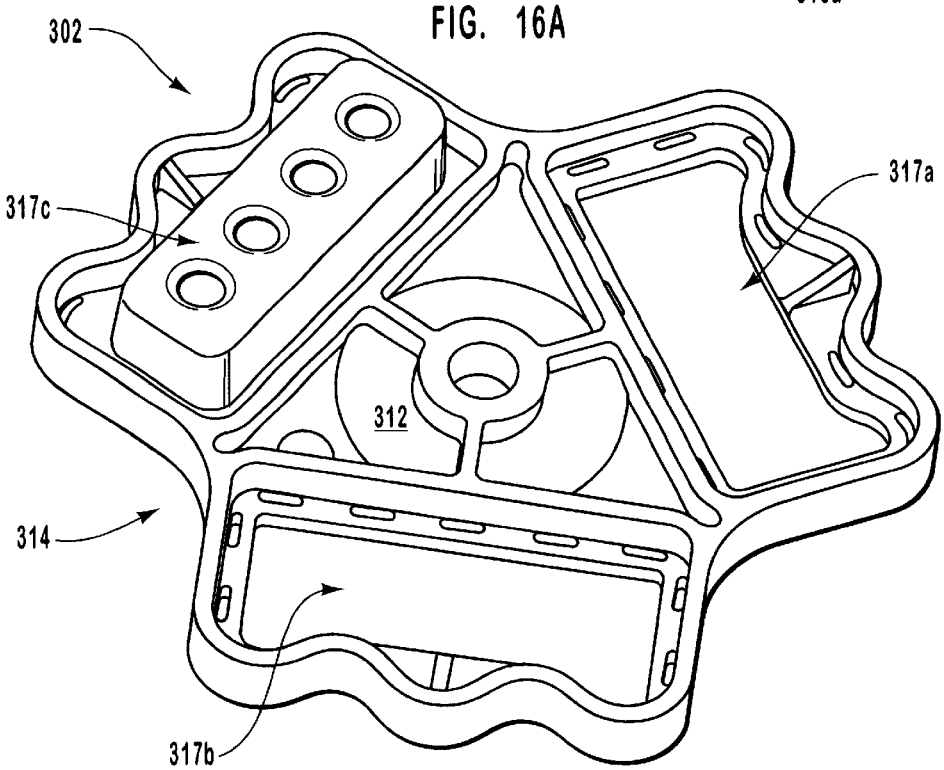
FIG. 16*b* is a bottom view of the cushioning member frame of FIG. 17*a* without the pads shown therein.

In the embodiment of FIGS. 16*a–b*, cushioning frame 314 comprises a first frame portion 317*a*, a second frame portion 317*b*, and a third frame portion 317*c*. First and second frame portions 317*a–b* essentially have large apertures therethrough, such that a significant amount of space is available for corresponding pad material 316*a–b*. Third frame portion 317*c* comprises more frame material and has less space therein for the corresponding pad material 316*c*.

Since arm 302*c* comprises a substantial amount of rigid or semi-rigid frame material 317*c* and a reduced amount of flexible pad material 316*c*, arm 302*c* is more rigid than arms 302*a* and 302*b*. The pad material 316*a* of arm 302*a* has a large groove therein, whereas the pad material 316*b* of arm 302*b* is solid. Thus, arm 302*a* is more flexible than arm 302*b*.

In summary, arm 302*c* comprises less pad material 316*c* and more frame material 317*c* than arm 302*b*, and is consequently more rigid than arm 302*b*. Arm 302*a* has a pad 316*a* having a substantial groove therein, and is consequently more flexible than arm 302*b*. Thus, arm 302*c* is more rigid than arm 302*b*, which is more rigid than arm 302*a*. In light of the different properties of the respective arms, a user desiring different cushioning properties for treadmill 310 can select a desired level of cushioning.

Nevertheless, although arms 302*a–c* of cushioning members 302 are depicted as having raised pad portions formed thereon that have different internal configurations, other embodiments of cushioning members perform the function thereof, such as by employing pad portions having different sizes or different densities. In addition, instead of cushioning members 302 being pivotally mounted below deck 340, cushioning members 302 can be movably attached to frame 324 by vertical axles.

Indicia, such as the numbers 1, 2, and 3 (or other indicia, such as lettering, color coding, providing other symbols, etc.) may be provided on the frame and/or pads of member 302 to allow a user to visually determine which amount of cushioning has been selected. For example, in the embodiment of FIG. 16*a*, the numeral "1" corresponds to the most flexible amount of cushioning (arm 302*a*), the numeral "2" corresponds to an intermediate amount of flexibility (arm 302*b*), and the numeral "3" corresponds to the most rigid amount of cushioning (arm 302*c*).

Figure 15:
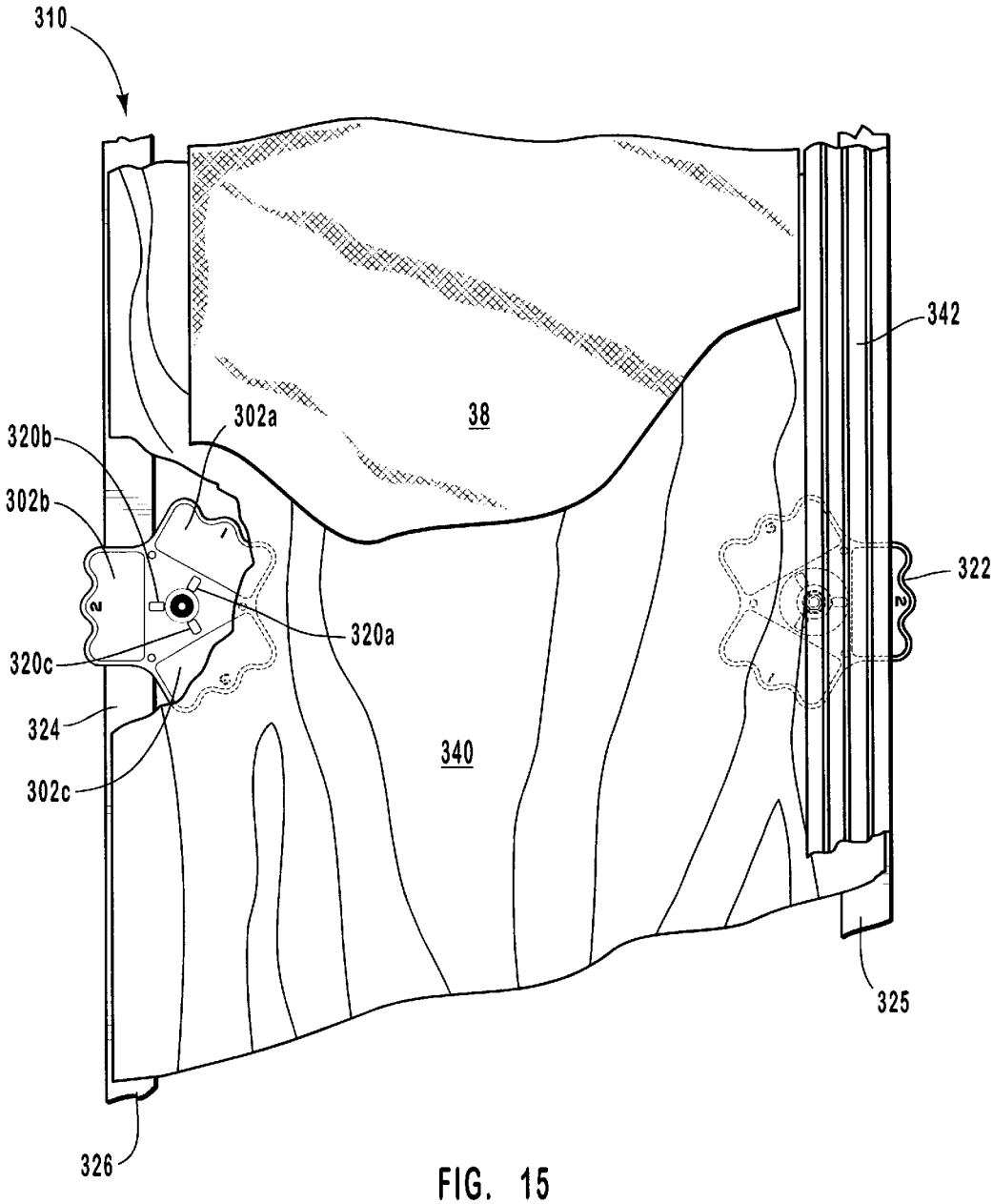
FIG. 15 is a cutaway top view of the treadmill of FIG. 13 with first and second cushioning members of the cushioning mechanism shown partially in phantom views.

Thus, as shown in the embodiment of FIG. 15, a user desiring an intermediate level of cushioning can move cushioning members 302 until the number 2 or other indicia appears on the edge of the treadmill of FIG. 15. In this embodiment, arms 302*b* of members 302 are mounted between frame 324 and deck 340 to thereby provide an intermediate level of flexibility to treadmill 310.

Gripping grooves 322 on members 302 allow a user to conveniently grip a selected member 320. Thus, members 302 can be selectively adjusted according to the desired amount of cushioning by gripping the gripping grooves 320 and rotating a selected member 302 in a horizontal plane. Such grooves 320 are one embodiment of structure capable of performing the function of a means for selectively adjusting cushioning members 302 to provide differing amounts of impact cushioning. Various other embodiments of structure capable of performing the function of such a means for selectively adjusting members 302 may be employed.

Impact absorbing mechanism 300 may further comprise a linkage or a cable (not shown), (e.g., similar to element 106 shown in FIG. 7), configured to mechanically interconnect cushioning members 302 such that movement of one cushioning member 302 results in corresponding movement of other cushioning members 302. Various embodiments of structure capable of performing the function of such means for mechanically interconnecting cushioning members 302, including those disclosed above with other embodiments of cushioning members, are equally effective. For example, each cushioning member 302 can be configured with a gear thereon. A chain can link the gears such that movement of one of cushioning members 302 results in corresponding movement of other cushioning members 302.

As shown in FIG. 15, frame 324 includes right and left frame members 325, 326, such as discussed with reference to base 12 of FIG. 1. Front and back rollers are attached laterally between respective front and back ends of frame members 325, 326 and an endless belt 332 is trained over the front and back rollers. A right side rail 342 is shown mounted on deck 340. Optionally, a left side rail may also be mounted on deck 340.

Deck 340 may be mounted on frame 324 in a variety of different manners, such as those discussed above with regard to deck 40 and frame 24. In one embodiment, the rear portion of the deck is immovably affixed to rear portions of opposing frame members 325, 326 while the front portion of the deck 340 is coupled to the front portions of opposing frame members 325, 326 through the use of elastomeric isolators coupled between the deck and the frame that allow some deflection between the deck 340 and the frame 324 during use.

Figure 17:
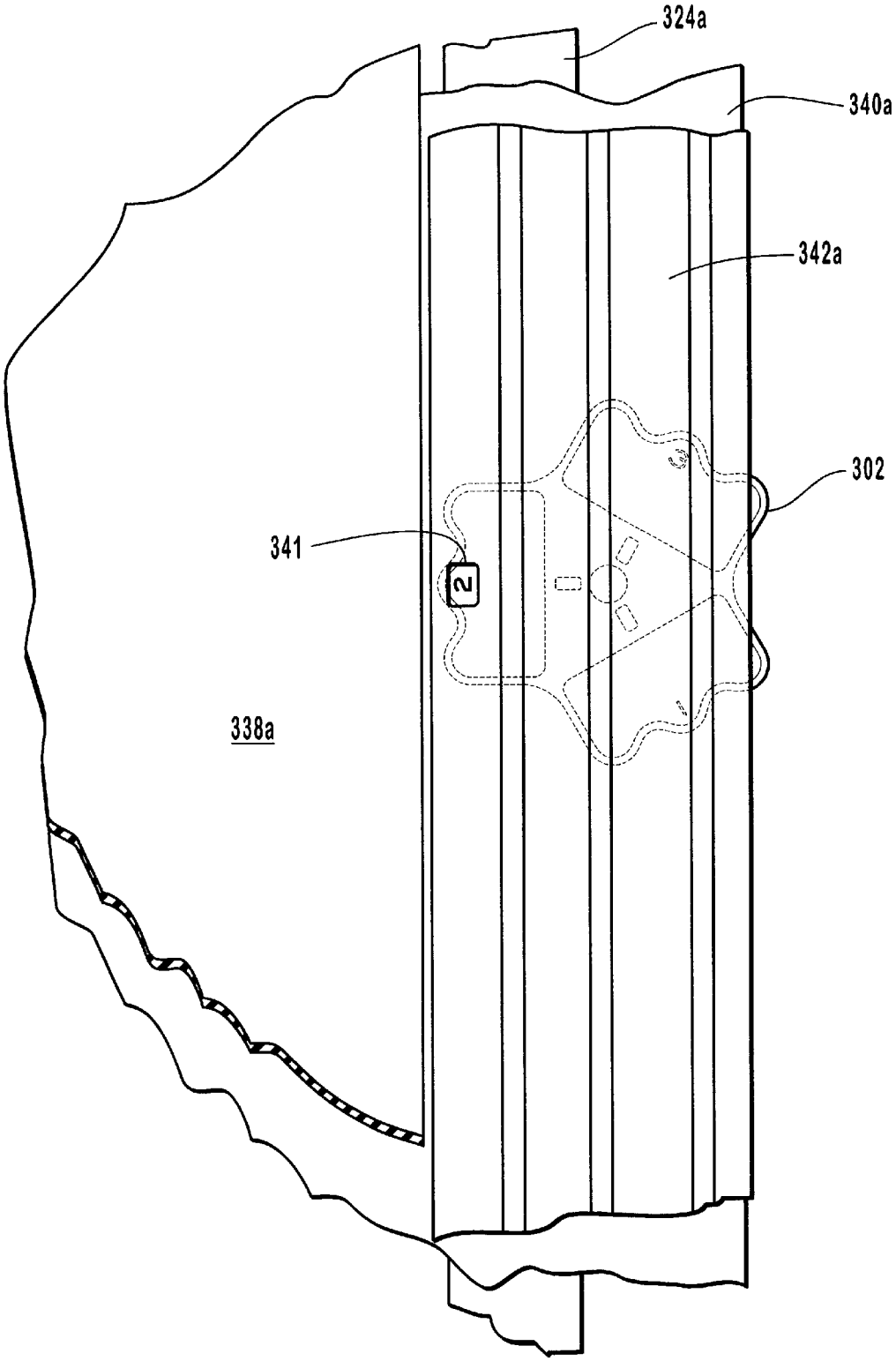
FIG. 17 is a cutaway top view of an alternate treadmill having the cushioning mechanism of FIG. 14 therein (shown partially in phantom lines) and having an aperture through the deck and side rail to thereby view a selected cushioning setting.

FIG. 17 provides a view of an alternate treadmill embodiment of the present invention, wherein first and second frame members 324*a* (only one frame member shown) are positioned below deck 340*a* in such as manner that the frame members 324*a* are inwardly disposed with respect to the sides of deck 340*a*. In this embodiment, the indicia (e.g., the numeral "2") on the cushioning member 302 is viewed by a user through the use of an aperture 341 through deck 340*a* through which the user can view the numeral. A corresponding aperture 341 also exists in the side deck rails 342*a*, which are mounted on the sides of deck 340*a* adjacent the treadmill belt 338*a*. Thus, in one embodiment, the deck 340*a* and side deck rail 342*a* of the present invention each have an aperture 341 therethrough such that the user can see through the deck 340*a* and rail 342*a* to view the indicia (e.g., the numeral "2") on respective members 302 on opposing sides of the deck 340*a*. One or both sides of deck 340*a* and one or both corresponding deck rails may have an aperture 341 therethrough corresponding to one or more respective cushioning members 302.

Figure 18:
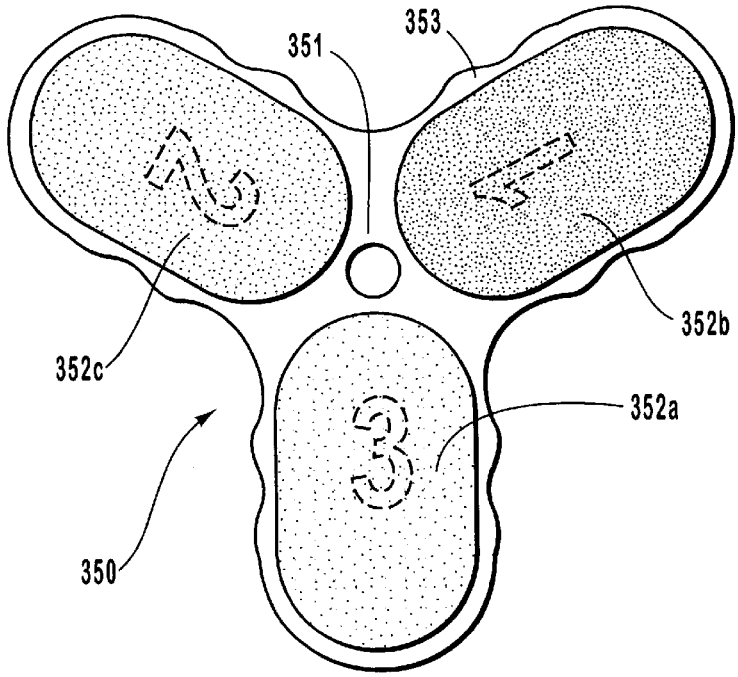
FIG. 18 is a bottom view of an alternate cushioning member with numbers indicating different cushioning portions shown in phantom lines.

FIG. 18 provides a top view of an alternate cushioning member 350 of FIG. 17. As illustrated, the cushioning member 350 includes a base 351 having a plurality of arms 352*a–c* radially extending therefrom. Each of the cushioning arms 352*a–c* have different cushioning properties to allow a user to selectively adjust the amount of cushioning provided. The difference in cushioning may be achieved through the use of material having different densities, different configurations, different sizes, by hollowing on or more portions, or through the use of stiffer materials surrounded by different amounts of padded material, for example. In one embodiment, arm 352*b* is denser, and consequently more stiff, than arm 352*a* and less dense and stiff than arm 352*c*. In yet another embodiment the pad on an intermediate level cushioning arm is larger than the least cushioned arm and smaller than the most cushioned arm. In yet another embodiment, an arm having a hollow or grooved pad, an arm having a solid pad, and an arm comprising more frame material than the other arms, as discussed with reference to member 302, are employed. Indicia, e.g., numerals corresponding to the differences in flexibility are shown in phantom lines. These indicia appear on the top portions of arms 352*a–c*.

Thus, an example of another cushioning mechanism of the present invention comprises first and second cushioning members, configured such as member 350, on opposing sides of a treadmill between the deck and the frame thereof. However, optionally member 350 may be employed on a single side to form a cushioning mechanism.

Figure 19:
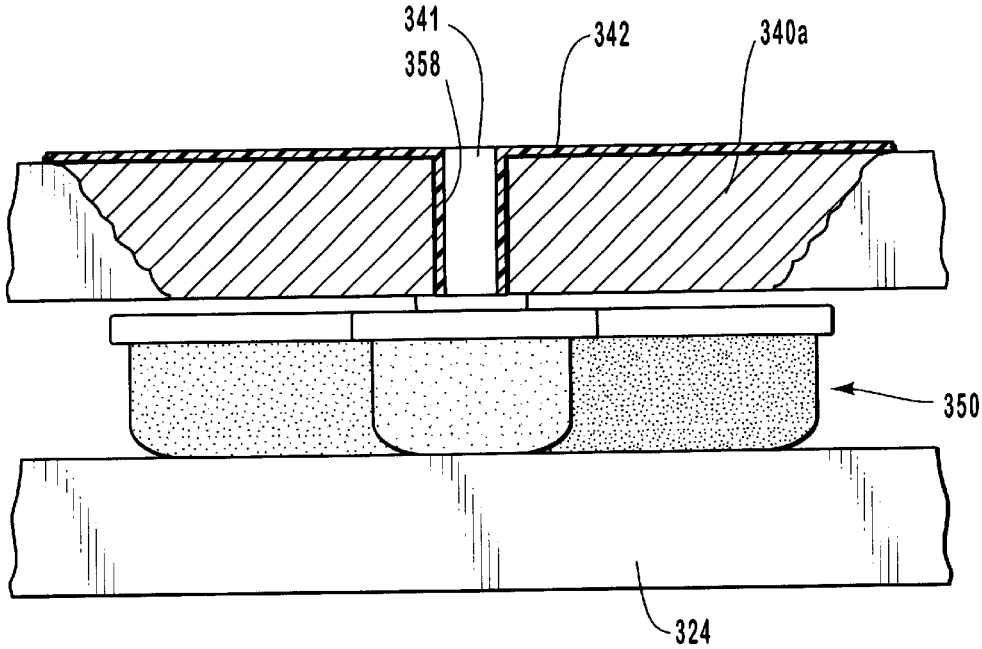
FIG. 19 is a partially cutaway side view of an alternate treadmill having an aperture through the treadmill side rail and deck to thereby allow viewing of the number shown in phantom view in FIG. 18.

As illustrated in FIG. 19, the cushioning member 350 is coupled between frame 324*a* and deck 340*a*, such as through the use of a vertical axle. Deck rail 342 is also shown. In the embodiment of FIG. 19, the deck rail 342 and deck 340*a* each have an aperture 341 therethrough that allows the user to visually inspect the corresponding indicia, e.g., numeral, to thereby determine the amount of cushioning selected by the user. The deck rail 342 of FIG. 19 has an integral tubular sleeve 358 that fits downwardly within the aperture in deck 340*a* to thereby enhance the aesthetic appearance of the aperture in deck 340*a*. By viewing through the sleeve 358, the user can see what level of cushioning has been selected. Optionally, a glass or plastic window may be placed in the aperture in the deck and/or rail. The deck rail(s) 342*a* discussed with respect to FIG. 17 may optionally employ the sleeve 358 shown in FIG. 19.

Thus, in order to view the indicia indicating the level of cushioning employed, the cushioning portions with the indicia thereon may extend out from the area directly between deck and the frame such that the indicia is visible to the user, or an aperture through the deck may be employed. Each of these approaches are examples of means for enabling a user to view the level of cushioning employed.

Figure 20:
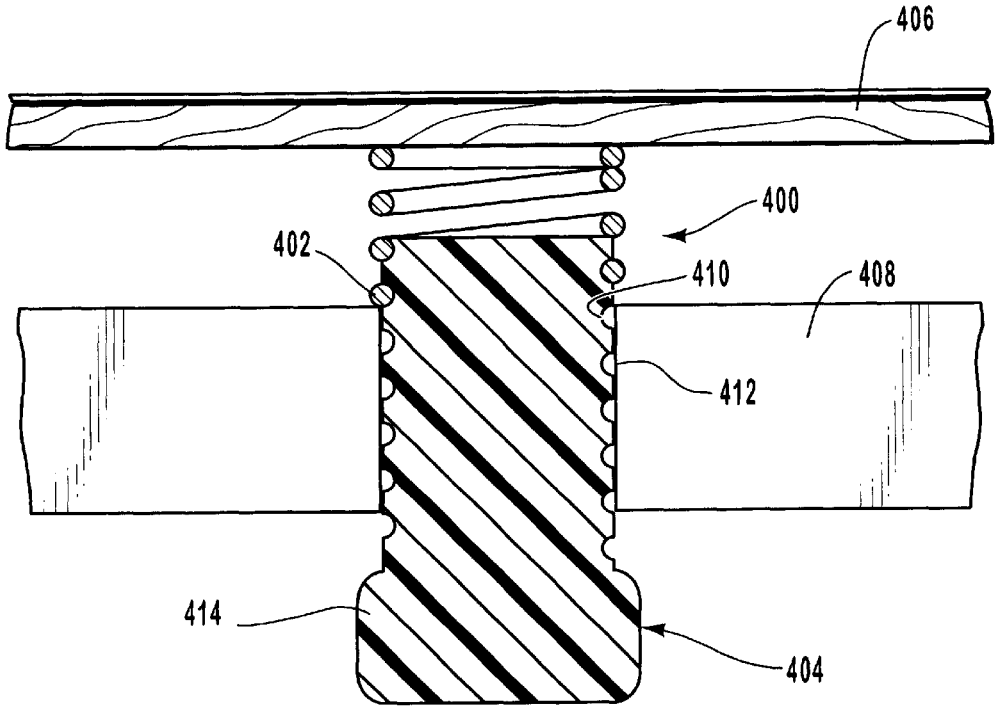
FIG. 20 illustrates another exemplary embodiment of a cushioning mechanism comprising a spring and a screw selectively mounted therein. The screw is shown in a cross sectional view.

FIG. 20 depicts an alternate embodiment of an adjustable cushioning mechanism 400 for use in an exercise device, such as a treadmill. Cushioning mechanism 400 comprises a spring 402 and a screw 404 threadedly mounted within the spring 402. Spring 402 is coupled between treadmill deck 406 and treadmill frame 408. An aperture 412 extends through frame 408 (or optionally, in another embodiment, through the deck) and receives screw 404 therethrough. The interior of spring 402 is configured to correspond to the threads 410 of screw 404 and to allow screw 404 to be threaded therethrough in a helical fashion.

As screw 404 extends into spring 402, the amount of cushioning is adjusted. The extension into or extraction from spring 402, respectively, decreases or increases the ability of the spring 402 to cushion. In other words, the movement of screw 404 with respect to spring 402 selectively increases or decreases the effective length of spring 402.

Thus, as screw 404 is threaded out of spring 402, the effective length of spring 402 is increased and the degree of flexibility increases; and as screw 404 is threaded into spring 402, the effective length of spring 402 is decreased and the degree of flexibility decreases.

In the embodiment of FIG. 20, the treadmill frame 408 is raised off the support surface sufficiently enough that the user can place his/her hand under frame 408, grip a knob 414 of screw 404, and selectively thread screw 404 into spring 402 or out of spring 402 to thereby adjust the amount of flexibility achieved. The space between the support surface and knob 414 allows the user to rotate knob 414. Alternatively, screw 404 is coupled to an adjustment mechanism that includes a motor to selectively adjust the cushioning by threading the screw.

Spring 402 may be coupled between deck 406 and frame 408 in a variety of different manners. For example, in one embodiment, the ends of the deck and the frame are coupled together in such a manner as to maintain spring 402 therebetween. In another embodiment, one or both ends of the spring are embedded into a corresponding deck or frame portion. For example, one end (e.g., the top end) of the spring may be embedded in the deck or frame while the opposing portion of the spring is not embedded but rests against the opposing frame or deck portion. In another embodiment, a screw extends from the deck or frame (or both) and connects with the corresponding end (e.g., the top end) of the spring. In yet another embodiment, the opposing ends of the spring are captured within cups (i.e., surrounded by the rims of the cups) mounted on respective portions of the deck and frame. One or both cups may have an aperture therethrough in order to allow the screw to extend therethrough.

In another embodiment, frame 408 is internally threaded so as to threadedly receive screw 404 therein. In this embodiment, screw 404 is threadedly received within frame 408 and spring 402. By way of example, screw 404 may comprise an elastomeric, plastic, or similar material, although a variety of different materials may be employed.

Thus, the present invention relates to treadmills with an impact absorbing mechanism that is configured to selectively adjust the cushioning of a user's impact.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A treadmill comprising:

a frame;

an endless belt, said belt having an upwardly exposed exercise section;

a deck disposed between said exercise section of said bolt and said frame; and impact absorbing means for adjustably cushioning impact between said deck and said frame, wherein adjustment of said impact absorbing means is achieved by rotating at least a portion of said impact absorbing means within a horizontal plane.

2. A treadmill comprising:

a frame;

an endless belt, said belt having an upwardly exposed exercise section;

a deck disposed between said exercise section of said belt and said frame; and impact absorbing means for adjustably cushioning impact between said deck and said frame, wherein adjustment of said impact absorbing means is achieved by horizontally rotating at least a portion of said impact absorbing means, wherein the impact absorbing means comprises an impact absorbing mechanism, the mechanism comprising a cushioning member, the cushioning member having a plurality of portions, each portion having a different cushioning property, such that horizontal rotation of the cushioning member adjusts the amount of cushioning between the deck and the frame.

3. A treadmill comprising:

a frame;

an endless belt, said belt having an upwardly exposed exercise section;

a deck disposed between said exercise section of said belt and said frame; and impact absorbing means for adjustably cushioning impact between said deck and said frame, wherein said impact absorbing means comprises a base baring a plurality of pads projecting therefrom, and wherein each of said plurality of pads has a different cushioning property.

4. A treadmill as recited in claim 3, wherein said base is flat, and wherein said pads project sidewardly from said base.

5. A treadmill comprising:

a frame;

an endless belt, said belt having an upwardly exposed exercise section;

a deck disposed between said exercise section of said belt and said frame; and impact absorbing means for adjustably cushioning impact between said deck and said frame, wherein adjustment of said impact absorbing means is achieved by horizontally rotating at least a portion of said impact absorbing means, wherein said impact absorbing means comprises a first cushioning member that includes a plurality of cushioning portions, and wherein each of said plurality of cushioning portions has a different cushioning property.

6. A treadmill as recited in claim 5, further comprising a second cushioning member, wherein said first and second cushioning members are disposed on opposing sides of said frame between said frame and said deck.

7. A treadmill comprising:

a frame;

an endless belt, said belt having an upwardly exposed exorcise section;

a deck disposed between said exercise section of said belt and said frame; and impact absorbing means for adjustably cushioning impact between said deck and said frame, further comprising an aperture in said deck such that at least a portion of said impact absorbing means is visible through said deck.

8. A treadmill as recited in claim 7, wherein said impact absorbing means has an indicia thereon that is visible through the aperture to indicate the amount of cushioning selected by a user.

9. A treadmill comprising:

a frame;

an endless belt, said belt having an upwardly exposed exercise section;

a deck disposed between said exercise section of said belt and said frame; and an impact absorbing mechanism configured to adjustably cushion impact between said deck and said frame, wherein adjustment of said impact absorbing mechanism is achieved by rotating at least a portion of said impact absorbing mechanism within a horizontal plane.

10. A treadmill comprising:

a frame;

an endless belt, said belt having an upwardly exposed exercise section;

a deck disposed between said exercise section of said belt and said frame; and an impact absorbing mechanism configured to adjustably cushion impact between said deck and said frame, wherein adjustment of said impact absorbing mechanism is achieved by horizontally rotating at least a portion of said impact absorbing mechanism, wherein the impact absorbing mechanism comprises a cushioning member, the cushioning member having a plurality of portions, each portion having a different cushioning property, such that horizontal rotation of the cushioning member adjusts the amount of cushioning between the deck and the frame.

11. A treadmill comprising:

a frame;

an endless belt, said belt having an upwardly exposed exercise section;

a deck disposed between said exercise section of said belt and said frame; and an impact absorbing mechanism configured to adjustably cushion impact between said deck and said frame, wherein adjustment of said impact absorbing mechanism is achieved by rotating at least a portion of said impact absorbing mechanism within a horizontal plane, wherein said impact absorbing mechanism comprises a first cushioning member that includes a plurality of cushioning portions, and wherein each of said plurality of cushioning portions has a different cushioning property.

12. A treadmill as recited in claim 11, further comprising a second cushioning member, wherein said first and second cushioning members are disposed on opposing sides of said frame between said frame and said deck.

13. A treadmill comprising:

a frame;

an endless belt, said belt having an upwardly exposed exercise section;

a deck disposed between said exercise section of said belt and said frame; and an impact absorbing mechanism configured to adjustably cushion impact between said deck and said frame, further comprising an aperture in said deck such that at least a portion of said impact absorbing mechanism is visible through said deck.

14. A treadmill as recited in claim 13, wherein said impact absorbing mechanism has an indicia thereon that is visible through the aperture to indicate the amount of cushioning selected by a user.

15. A treadmill comprising:

a frame;

an endless belt, said belt having an upwardly exposed exercise section;

a deck disposed between said exercise section of said bolt and said frame; and an impact absorbing mechanism configured to adjustably cushion impact between said deck mid said frame, wherein adjustment of said impact absorbing mechanism is achieved by helically rotating one portion of said impact absorbing mechanism with respect to another portion of said impact absorbing mechanism such that movement of one portion selectively increases the effective length of another portion.

16. A treadmill as recited in claim 14, wherein the impact absorbing mechanism comprises a spring disposed between the deck and the frame and a screw configured to thread within the spring.

17. A treadmill as recited in claim 16, wherein the impact absorbing mechanism comprises a coil spring coupled between the treadmill deck and to treadmill frame; and an elastomeric screw threadedly coupled to the spring such that the screw selectively threads within the center of said spring.

18. A treadmill as recited in claim 16, wherein the screw includes a knob configured to adjust the screw.

19. A treadmill comprising:

a frame;

an endless belt, said belt having an upwardly exposed exercise section;

a deck disposed between said exercise section of said belt and said frame; and a coil spring disposed between the deck and the frame; and a screw configured to selectively thread within the spring.

20. A treadmill as recited in claim 19, wherein movement of the screw selectively increases the effective length of the spring.

* * * * *

UNITED STATES PATENT AND TRADEMARK OFFICE

CERTIFICATE OF CORRECTION

PATENT NO. : 6,821,230 B2
APPLICATION NO. : 09/953589
DATED : November 23, 2004
INVENTOR(S) : Dalebout et al.

It is certified that error appears in the above-identified patent and that said Letters Patent is hereby corrected as shown below:

Column 2
Line 30, change “type” to --types--
Line 37, after “herein” insert --,--
Line 44, change “maybe” to --may be--
Line 46, change “maybe” to --may be--

Column 3
Line 42, after “is” insert --a--

Column 4
Line 51, after “exercise base” insert --12--

Column 5
Line 43, change “similar” to --similarly--

Column 6
Line 6, change “platform” to --platforms--
Line 16, after “mechanism” insert --48--
Line 47, change “adjustably” to --adjust--
Line 58, change “48” to --58--

Column 7
Line 9, change “38” to --40--
Line 26, remove “just”
Line 44, before “structure” insert --a--

Column 8
Line 4, remove “58”
Line 52, change “characteristic” to --characteristics--

Column 9
Line 14, change “92” to --82--
Line 17, change “82” to --92--
Line 29, after “82” insert --can be--
Line 42, after “84” change “have” to --has--
Line 50, change “cushion” to --cushioning--
Line 51, before “structure” insert --a--

Column 10
Line 7, after “portion” change “have” to --has--
Line 27, after “of deck” insert --40--

UNITED STATES PATENT AND TRADEMARK OFFICE

CERTIFICATE OF CORRECTION

PATENT NO. : 6,821,230 B2
APPLICATION NO. : 09/953589
DATED : November 23, 2004
INVENTOR(S) : Dalebout et al.

It is certified that error appears in the above-identified patent and that said Letters Patent is hereby corrected as shown below:

Column 11
Line 32, change “depicts” to --depict--
Line 56, change “effecting” to --affecting--
Line 62, after “one embodiment of” insert --a--
Line 65, before “differing amount” insert --a--
Line 66, before “structure” insert --a--

Column 12
Line 9, before “structure” insert --a--
Line 45, after “mirror image” insert --of--
Line 59, before “structure” insert --a--

Column 13
Line 5, before “structure” insert --a--
Line 9, before “structure” insert --a--
Line 23, change “140” to --40--
Line 34, after “142 to change” remove “in”

Column 14
Line 27, after “increase” insert --,--

Column 15
Line 15, after “202, 204 to change” remove “in”
Line 22, before “structure” insert --a--

Column 16
Line 29, change “effecting” to --affecting--

Column 18
Line 63, after “hollowing” change “on” to --one--

Column 20
Line 50, change “bolt” to --belt--

Column 21
Line 17, change “baring” to --having--

UNITED STATES PATENT AND TRADEMARK OFFICE

CERTIFICATE OF CORRECTION

PATENT NO. : 6,821,230 B2
APPLICATION NO. : 09/953589
DATED : November 23, 2004
INVENTOR(S) : Dalebout et al.

It is certified that error appears in the above-identified patent and that said Letters Patent is hereby corrected as shown below:

Column 22
Line 61, change "bolt" to --belt--
Line 64, change "mid" to --and--

Column 23
Line 11, after "treadmill deck and" change "to" to --the--

Signed and Sealed this

Twenty-fourth Day of April, 2007

JON W. DUDAS
*Director of the United States Patent and Trademark Office*